US011534654B2

(12) United States Patent
Silcock et al.

(10) Patent No.: US 11,534,654 B2
(45) Date of Patent: Dec. 27, 2022

(54) SYSTEMS AND METHODS FOR AN INTERACTIVE PEDALED EXERCISE DEVICE

(71) Applicant: iFIT Inc., Logan, UT (US)

(72) Inventors: Ryan Silcock, Logan, UT (US); Darren C. Ashby, Richmond, UT (US); Spencer Jackson, Logan, UT (US); Blaine Dye, Nibley, UT (US)

(73) Assignee: iFIT Inc., Logan, UT (US)

( * ) Notice: Subject to any disclaimer, the term of this patent is extended or adjusted under 35 U.S.C. 154(b) by 11 days.

(21) Appl. No.: 16/750,925

(22) Filed: Jan. 23, 2020

(65) Prior Publication Data

US 2020/0238130 A1 Jul. 30, 2020

Related U.S. Application Data

(60) Provisional application No. 62/796,952, filed on Jan. 25, 2019.

(51) Int. Cl.
*A63B 22/00* (2006.01)
*A63B 24/00* (2006.01)
(Continued)

(52) U.S. Cl.
CPC ..... *A63B 22/0012* (2013.01); *A63B 21/023* (2013.01); *A63B 21/0442* (2013.01);
(Continued)

(58) Field of Classification Search
CPC ..... A63B 22/0012; A63B 24/0062; A63B 71/0622; A63B 22/005; A63B 21/023; A63B 21/4035; A63B 22/0605; A63B 21/4034; A63B 21/0442; A63B 2220/51; A63B 2024/0093; A63B 71/0666; A63B 22/0005; A63B 2071/0666; A63B 21/005; A63B 21/008; A63B 21/015; A63B 2071/0638; A63B 2071/0655;
(Continued)

(56) References Cited

U.S. PATENT DOCUMENTS 3,123,646 A 3/1964 Easton
3,579,339 A 5/1971 Chang
(Continued)

FOREIGN PATENT DOCUMENTS

CA 2599244 2/2008
CN 101108274 1/2008
(Continued)

OTHER PUBLICATIONS

U.S. Appl. No. 13/088,007, filed Apr. 15, 2011, Scott R. Watterson.
(Continued)

*Primary Examiner* — Sundhara M Ganesan
(74) *Attorney, Agent, or Firm* — Ray Quinney & Nebeker P.C.; Paul N. Taylor

(57) ABSTRACT

An exercise device includes a frame, handlebars supported by the frame, and a computing device. The handlebars include a yoke that is movable relative to the frame, a biasing element positioned between the yoke and the frame, and a sensor configured to measure a movement of the yoke.

21 Claims, 14 Drawing Sheets

(51) Int. Cl.

| | |
|---|---|
| ***A63B 71/06*** | (2006.01) |
| ***A63B 21/02*** | (2006.01) |
| ***A63B 21/00*** | (2006.01) |
| ***A63B 22/06*** | (2006.01) |
| ***A63B 21/04*** | (2006.01) |

(52) U.S. Cl.
CPC ..... *A63B 21/4034* (2015.10); *A63B 21/4035* (2015.10); *A63B 22/0005* (2015.10); *A63B 22/0605* (2013.01); *A63B 24/0062* (2013.01); *A63B 71/0622* (2013.01); *A63B 2024/0093* (2013.01); *A63B 2071/0666* (2013.01); *A63B 2220/51* (2013.01)

(58) Field of Classification Search
CPC ..... A63B 2071/0675; A63B 2220/10; A63B 2220/16; A63B 2220/40; A63B 2220/803; A63B 2225/20; A63B 2230/06; A63B 2230/42; G05G 9/047
See application file for complete search history.

(56) References Cited

U.S. PATENT DOCUMENTS 4,023,795 A 5/1977 Pauls
4,300,760 A 11/1981 Bobroff
4,489,938 A * 12/1984 Darzinskis ..... A63B 22/0076 482/901
D286,311 S 10/1986 Martinell
4,681,318 A 7/1987 Lay
4,684,126 A 8/1987 Dalebout
4,728,102 A 3/1988 Pauls
4,750,736 A 6/1988 Watterson
4,796,881 A 1/1989 Watterson
4,813,667 A 3/1989 Watterson
4,830,371 A 5/1989 Lay
4,844,451 A 7/1989 Bersonnet
4,850,585 A 7/1989 Dalebout
D304,849 S 11/1989 Watterson
4,880,225 A 11/1989 Lucas
4,883,272 A 11/1989 Lay
D306,468 S 3/1990 Watterson
D306,891 S 3/1990 Watterson
4,913,396 A 4/1990 Dalebout
D307,614 S 5/1990 Bingham
D307,615 S 5/1990 Bingham
4,921,242 A 5/1990 Watterson
4,932,650 A 6/1990 Bingham
D309,167 S 7/1990 Griffin
D309,485 S 7/1990 Bingham
4,938,478 A 7/1990 Lay
D310,253 S 8/1990 Bersonnet
4,955,599 A 9/1990 Bersonnet
4,971,316 A 11/1990 Dalebout
D313,055 S 12/1990 Watterson
4,974,832 A 12/1990 Dalebout
4,976,435 A * 12/1990 Shatford ..... A63F 13/06 482/902
4,979,737 A 12/1990 Kock
4,981,294 A 1/1991 Dalebout
D315,765 S 3/1991 Measom
4,998,725 A 3/1991 Watterson
5,000,442 A 3/1991 Dalebout
5,000,443 A 3/1991 Dalebout
5,000,444 A 3/1991 Dalebout
D316,124 S 4/1991 Dalebout
5,013,033 A 5/1991 Watterson
5,014,980 A 5/1991 Bersonnet
5,016,871 A 5/1991 Dalebout
D318,085 S 7/1991 Jacobson
D318,086 S 7/1991 Bingham
D318,699 S 7/1991 Jacobson
5,029,801 A 7/1991 Dalebout
5,034,576 A 7/1991 Dalebout
5,058,881 A 10/1991 Measom
5,058,882 A 10/1991 Dalebout
D321,388 S 11/1991 Dalebout
5,062,626 A 11/1991 Dalebout
5,062,627 A 11/1991 Bingham
5,062,632 A 11/1991 Dalebout
5,062,633 A 11/1991 Engel
5,067,710 A 11/1991 Watterson
5,072,929 A 12/1991 Peterson
D323,009 S 1/1992 Dalebout
D323,198 S 1/1992 Dalebout
D323,199 S 1/1992 Dalebout
D323,863 S 2/1992 Watterson
5,088,729 A 2/1992 Dalebout
5,090,694 A 2/1992 Pauls
5,102,380 A 4/1992 Jacobson
5,104,120 A 4/1992 Watterson
5,108,093 A 4/1992 Watterson
D326,491 S 5/1992 Dalebout
5,122,105 A 6/1992 Engel
5,135,216 A 8/1992 Bingham
5,147,265 A 9/1992 Pauls
5,149,084 A 9/1992 Dalebout
5,149,312 A 9/1992 Croft et al.
5,171,196 A 12/1992 Lynch
D332,347 S 1/1993 Raadt
5,190,505 A 3/1993 Dalebout
5,192,255 A 3/1993 Dalebout
5,195,937 A 3/1993 Engel
5,203,826 A 4/1993 Dalebout
D335,511 S 5/1993 Engel
D335,905 S 5/1993 Cutter
D336,498 S 6/1993 Engel
5,217,487 A 6/1993 Engel
D337,361 S 7/1993 Engel
D337,666 S 7/1993 Peterson
D337,799 S 7/1993 Cutter
5,226,866 A 7/1993 Engel
5,244,446 A 9/1993 Engel
5,247,853 A 9/1993 Dalebout
5,259,611 A 11/1993 Dalebout
D342,106 S 12/1993 Campbell
5,279,528 A 1/1994 Dalebout
D344,112 S 2/1994 Smith
D344,557 S 2/1994 Ashby
5,282,776 A 2/1994 Dalebout
5,295,931 A 3/1994 Dreibelbis
5,302,161 A 4/1994 Loubert
D347,251 S 5/1994 Dreibelbis
5,316,534 A 5/1994 Dalebout
D348,493 S 7/1994 Ashby
D348,494 S 7/1994 Ashby
5,328,164 A 7/1994 Soga
D349,931 S 8/1994 Bostic
5,336,142 A 8/1994 Dalebout
5,344,376 A 9/1994 Bostic
D351,202 S 10/1994 Bingham
D351,435 S 10/1994 Peterson
D351,633 S 10/1994 Bingham
D352,534 S 11/1994 Dreibelbis
D353,422 S 12/1994 Bostic
5,372,559 A 12/1994 Dalebout
5,374,228 A 12/1994 Buisman
5,382,221 A 1/1995 Hsu
5,387,168 A 2/1995 Bostic
5,393,690 A 2/1995 Fu
D356,128 S 3/1995 Smith
5,409,435 A 4/1995 Daniels
5,429,563 A 7/1995 Engel
5,431,612 A 7/1995 Holden
D360,915 S 8/1995 Bostic
5,468,205 A 11/1995 McFall
5,489,249 A 2/1996 Brewer
5,492,517 A 2/1996 Bostic
D367,689 S 3/1996 Wilkinson
5,511,740 A 4/1996 Loubert
5,512,025 A 4/1996 Dalebout
D370,949 S 6/1996 Furner
D371,176 S 6/1996 Furner

(56) References Cited

U.S. PATENT DOCUMENTS 5,527,245 A 6/1996 Dalebout
5,529,553 A 6/1996 Finlayson
5,540,429 A 7/1996 Dalebout
5,549,533 A 8/1996 Olson
5,554,085 A 9/1996 Dalebout
5,569,128 A 10/1996 Dalebout
5,591,105 A 1/1997 Dalebout
5,591,106 A 1/1997 Dalebout
5,595,556 A 1/1997 Dalebout
5,607,375 A 3/1997 Dalebout
5,611,539 A 3/1997 Watterson
5,622,527 A 4/1997 Watterson
5,626,538 A 5/1997 Dalebout
5,626,542 A 5/1997 Dalebout
D380,024 S 6/1997 Novak
5,637,059 A 6/1997 Dalebout
D380,509 S 7/1997 Wilkinson
5,643,153 A 7/1997 Nylen
5,645,509 A 7/1997 Brewer
D384,118 S 9/1997 Deblauw
5,662,557 A 9/1997 Watterson
5,669,857 A 9/1997 Watterson
5,672,140 A 9/1997 Watterson
5,674,156 A 10/1997 Watterson
5,674,453 A 10/1997 Watterson
5,676,624 A 10/1997 Watterson
5,683,331 A 11/1997 Dalebout
5,683,332 A 11/1997 Watterson
D387,825 S 12/1997 Fleck
5,695,433 A 12/1997 Buisman
5,695,434 A 12/1997 Dalebout
5,695,435 A 12/1997 Dalebout
5,702,325 A 12/1997 Watterson
5,704,879 A 1/1998 Watterson
5,718,657 A 2/1998 Dalebout et al.
5,720,200 A 2/1998 Anderson
5,720,698 A 2/1998 Dalebout
D392,006 S 3/1998 Dalebout
5,722,922 A 3/1998 Watterson
5,733,229 A 3/1998 Dalebout
5,743,833 A 4/1998 Watterson
5,762,584 A 6/1998 Daniels
5,762,587 A 6/1998 Dalebout
5,772,560 A 6/1998 Watterson
5,810,698 A 9/1998 Hullett
5,827,155 A 10/1998 Jensen
5,830,114 A 11/1998 Halfen
5,839,990 A * 11/1998 Virkkala ..... G06F 3/0383 482/7
5,860,893 A 1/1999 Watterson
5,860,894 A 1/1999 Dalebout
5,899,834 A 5/1999 Dalebout
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
6,003,166 A 12/1999 Hald
6,019,710 A 2/2000 Dalebout
6,027,429 A 2/2000 Daniels
6,033,347 A 3/2000 Dalebout et al.
D425,940 S 5/2000 Halfen
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald
6,238,323 B1 5/2001 Simonson
6,244,988 B1 * 6/2001 Delman ..... A63B 71/0622 482/901
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout
6,312,363 B1 11/2001 Watterson
D452,338 S 12/2001 Dalebout
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris
6,422,980 B1 7/2002 Simonson
6,447,424 B1 9/2002 Ashby et al.
6,458,060 B1 10/2002 Watterson
6,458,061 B2 10/2002 Simonson
6,471,622 B1 10/2002 Hammer
6,563,225 B2 5/2003 Soga
6,601,016 B1 7/2003 Brown
6,623,140 B2 9/2003 Watterson
6,626,799 B2 9/2003 Watterson
6,652,424 B2 11/2003 Dalebout
6,685,607 B1 2/2004 Olson
6,695,581 B2 2/2004 Wasson
6,701,271 B2 3/2004 Willner
6,702,719 B1 3/2004 Brown
6,712,740 B2 3/2004 Simonson
6,730,002 B2 5/2004 Hald
6,743,153 B2 6/2004 Watterson
6,746,371 B1 6/2004 Brown
6,749,537 B1 6/2004 Hickman
6,761,667 B1 7/2004 Cutler et al.
6,770,015 B2 8/2004 Simonson
6,786,852 B2 9/2004 Watterson
6,808,472 B1 10/2004 Hickman
6,821,230 B2 11/2004 Dalebout
6,830,540 B2 12/2004 Watterson
6,863,641 B1 3/2005 Brown
6,866,613 B1 3/2005 Brown
6,875,160 B2 4/2005 Watterson
D507,311 S 7/2005 Butler
6,918,858 B2 7/2005 Watterson
6,918,860 B1 * 7/2005 Nusbaum ..... A63B 22/0605 482/57
6,921,351 B1 7/2005 Hickman et al.
6,974,404 B1 12/2005 Watterson
6,997,852 B2 2/2006 Watterson
7,025,713 B2 4/2006 Dalebout
D520,085 S 5/2006 Willardson
7,044,897 B2 5/2006 Myers
7,052,442 B2 5/2006 Watterson
7,060,006 B1 6/2006 Watterson
7,060,008 B2 6/2006 Watterson et al.
7,070,539 B2 7/2006 Brown
7,097,588 B2 8/2006 Watterson
D527,776 S 9/2006 Willardson
7,112,168 B2 9/2006 Dalebout et al.
7,128,693 B2 10/2006 Brown
7,166,062 B1 1/2007 Watterson
7,166,064 B2 1/2007 Watterson
7,169,087 B2 1/2007 Ercanbrack
7,169,093 B2 1/2007 Simonson et al.
7,192,388 B2 3/2007 Dalebout
7,250,022 B2 7/2007 Dalebout
7,282,016 B2 10/2007 Simonson
7,285,075 B2 10/2007 Cutler
7,344,481 B2 3/2008 Watterson
7,377,882 B2 5/2008 Watterson
7,425,188 B2 9/2008 Ercanbrack
7,429,236 B2 9/2008 Dalebout
7,455,622 B2 11/2008 Watterson
7,482,050 B2 1/2009 Olson
D588,655 S 3/2009 Utykanski
7,510,509 B2 3/2009 Hickman
7,537,546 B2 5/2009 Watterson
7,537,549 B2 5/2009 Nelson
7,537,552 B2 5/2009 Dalebout
7,540,828 B2 6/2009 Watterson
7,549,947 B2 6/2009 Hickman
7,556,590 B2 7/2009 Watterson et al.
7,563,203 B2 7/2009 Dalebout

(56) References Cited

U.S. PATENT DOCUMENTS 7,575,536 B1 8/2009 Hickman
7,601,105 B1 10/2009 Gipson, III
7,604,573 B2 10/2009 Dalebout
D604,373 S 11/2009 Dalebout
7,618,350 B2 11/2009 Dalebout
7,618,357 B2 11/2009 Dalebout
7,625,315 B2 12/2009 Hickman
7,625,321 B2 12/2009 Simonson
7,628,730 B1 12/2009 Watterson
7,628,737 B2 12/2009 Kowallis
7,637,847 B1 12/2009 Hickman
7,645,212 B2 1/2010 Ashby et al.
7,645,213 B2 1/2010 Watterson
7,658,698 B2 2/2010 Pacheco
7,674,205 B2 3/2010 Dalebout
7,713,171 B1 5/2010 Hickman
7,713,172 B2 5/2010 Watterson
7,713,180 B2 5/2010 Wickens
7,717,828 B2 5/2010 Simonson
7,736,279 B2 6/2010 Dalebout
7,740,563 B2 6/2010 Dalebout
7,749,144 B2 7/2010 Hammer
7,766,797 B2 8/2010 Dalebout
7,771,329 B2 8/2010 Dalebout
7,775,940 B2 8/2010 Dalebout
7,789,800 B1 9/2010 Watterson
7,798,946 B2 9/2010 Dalebout
7,815,550 B2 10/2010 Watterson
7,857,731 B2 12/2010 Hickman
7,862,475 B2 1/2011 Watterson
7,862,478 B2 1/2011 Watterson
7,862,483 B2 1/2011 Hendrickson
D635,207 S 3/2011 Dalebout
7,901,330 B2 3/2011 Dalebout
7,909,740 B2 3/2011 Dalebout
7,980,996 B2 7/2011 Hickman
7,981,000 B2 7/2011 Watterson
7,985,164 B2 7/2011 Ashby
8,029,415 B2 10/2011 Ashby et al.
8,033,960 B1 10/2011 Dalebout
D650,451 S 12/2011 Olson
D652,877 S 1/2012 Dalebout
8,152,702 B2 4/2012 Pacheco
D659,775 S 5/2012 Olson
D659,777 S 5/2012 Watterson
D660,383 S 5/2012 Watterson
D664,613 S 7/2012 Dalebout
8,251,874 B2 8/2012 Ashby
8,298,123 B2 10/2012 Hickman
8,298,125 B2 10/2012 Colledge
D671,177 S 11/2012 Sip
D671,178 S 11/2012 Sip
D673,626 S 1/2013 Olson
8,690,735 B2 4/2014 Watterson
D707,763 S 6/2014 Cutler
8,740,753 B2 6/2014 Olson
8,758,201 B2 6/2014 Ashby
8,771,153 B2 7/2014 Dalebout
8,784,270 B2 7/2014 Watterson
8,808,148 B2 8/2014 Watterson
8,814,762 B2 8/2014 Butler
D712,493 S 9/2014 Ercanbrack
8,840,075 B2 9/2014 Olson
8,845,493 B2 9/2014 Watterson
8,870,726 B2 10/2014 Watterson
8,876,668 B2 11/2014 Hendrickson
8,894,549 B2 11/2014 Colledge
8,894,555 B2 11/2014 Olson
8,911,330 B2 12/2014 Watterson
8,920,288 B2 12/2014 Dalebout
8,986,165 B2 3/2015 Ashby
8,992,364 B2 3/2015 Law
8,992,387 B2 3/2015 Watterson
D726,476 S 4/2015 Ercanbrack
9,028,368 B2 5/2015 Ashby
9,028,370 B2 5/2015 Watterson
9,039,578 B2 5/2015 Dalebout
D731,011 S 6/2015 Buchanan
9,072,930 B2 7/2015 Ashby
9,119,983 B2 9/2015 Rhea
9,123,317 B2 9/2015 Watterson
9,126,071 B2 9/2015 Smith
9,126,072 B2 9/2015 Watterson
9,138,615 B2 9/2015 Olson
9,142,139 B2 9/2015 Watterson
9,144,703 B2 9/2015 Dalebout
9,149,683 B2 9/2015 Smith
9,186,535 B2 11/2015 Ercanbrack
9,186,549 B2 11/2015 Watterson
9,254,409 B2 2/2016 Dalebout
9,254,416 B2 2/2016 Ashby
9,278,248 B2 3/2016 Tyger
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson
9,352,186 B2 5/2016 Watterson
9,375,605 B2 6/2016 Tyger
9,381,394 B2 7/2016 Mortensen
9,387,387 B2 7/2016 Dalebout
9,393,453 B2 7/2016 Watterson
9,403,047 B2 8/2016 Olson
9,403,051 B2 8/2016 Cutler
9,421,416 B2 8/2016 Mortensen
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen
9,498,668 B2 11/2016 Smith
9,517,378 B2 12/2016 Ashby
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout
9,586,090 B2 3/2017 Watterson
9,604,099 B2 3/2017 Taylor
9,616,276 B2 4/2017 Dalebout
9,616,278 B2 4/2017 Olson
9,623,281 B2 4/2017 Hendrickson
9,636,567 B2 5/2017 Brammer
9,675,839 B2 6/2017 Dalebout
9,682,307 B2 6/2017 Dalebout
9,694,234 B2 7/2017 Dalebout
9,694,242 B2 7/2017 Ashby
9,737,755 B2 8/2017 Dalebout
9,757,605 B2 9/2017 Olson
9,764,186 B2 9/2017 Dalebout
9,767,785 B2 9/2017 Ashby
9,776,030 B1 * 10/2017 Louis ..... A63B 21/068
9,795,822 B2 10/2017 Smith
9,808,672 B2 11/2017 Dalebout
9,849,326 B2 12/2017 Smith
9,878,210 B2 1/2018 Watterson
9,889,334 B2 2/2018 Ashby
9,889,339 B2 2/2018 Douglass
9,937,376 B2 4/2018 McInelly
9,937,377 B2 4/2018 McInelly
9,937,378 B2 4/2018 Dalebout
9,937,379 B2 4/2018 Mortensen
9,943,719 B2 4/2018 Smith
9,943,722 B2 4/2018 Dalebout
9,948,037 B2 4/2018 Ashby
9,968,816 B2 5/2018 Olson
9,968,821 B2 5/2018 Finlayson
9,968,823 B2 5/2018 Cutler
10,010,755 B2 7/2018 Watterson
10,010,756 B2 7/2018 Watterson

(56) References Cited

U.S. PATENT DOCUMENTS 10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 9/2018 Smith
10,071,285 B2 9/2018 Smith
10,085,586 B2 10/2018 Smith
10,086,254 B2 10/2018 Watterson
10,136,842 B2 11/2018 Ashby
10,186,161 B2 1/2019 Watterson
10,188,890 B2 1/2019 Olson
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,664 B2 3/2019 Dalebout
10,252,109 B2 4/2019 Watterson
10,258,828 B2 4/2019 Dalebout
10,272,317 B2 4/2019 Watterson
10,279,212 B2 5/2019 Dalebout
10,293,211 B2 5/2019 Watterson
D852,292 S 6/2019 Cutler
10,343,017 B2 7/2019 Jackson
10,376,736 B2 8/2019 Powell
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby
10,441,840 B2 10/2019 Dalebout
10,449,416 B2 10/2019 Dalebout
10,466,803 B1 * 11/2019 Rutledge ..... G06F 3/0338
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
2002/0016235 A1 2/2002 Ashby
2002/0077221 A1 6/2002 Dalebout
2002/0159253 A1 10/2002 Dalebout
2003/0045406 A1 3/2003 Stone
2003/0171190 A1 * 9/2003 Rice ..... A63F 13/06 482/57
2004/0091307 A1 5/2004 James
2004/0171464 A1 9/2004 Ashby
2004/0171465 A1 9/2004 Hald
2005/0049123 A1 3/2005 Dalebout
2005/0077805 A1 4/2005 Dalebout
2005/0107229 A1 5/2005 Wickens
2005/0164839 A1 7/2005 Watterson
2005/0272577 A1 12/2005 Olson
2006/0063645 A1 * 3/2006 Chiang ..... A63B 24/0084 482/8
2006/0292534 A1 * 12/2006 Tomes ..... A63F 13/06 482/8
2007/0042868 A1 2/2007 Fisher et al.
2007/0117683 A1 5/2007 Ercanbrack
2007/0254778 A1 11/2007 Ashby
2007/0281828 A1 * 12/2007 Rice ..... A63F 13/06 482/4
2008/0051256 A1 2/2008 Ashby
2008/0102424 A1 * 5/2008 Holljes ..... A63B 21/4034 434/247
2008/0242520 A1 10/2008 Hubbard
2008/0269025 A1 10/2008 Badarneh et al.
2008/0300110 A1 12/2008 Smith
2009/0105052 A1 4/2009 Dalebout
2010/0035726 A1 * 2/2010 Fisher ..... A63B 24/0084 482/8
2010/0081548 A1 * 4/2010 Labedz ..... A63B 71/0622 482/148
2010/0242246 A1 9/2010 Dalebout
2012/0237911 A1 9/2012 Watterson
2012/0295774 A1 11/2012 Dalebout
2013/0123083 A1 5/2013 Sip
2013/0130798 A1 * 5/2013 Nir ..... A63F 13/803 463/36
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson
2013/0196822 A1 8/2013 Watterson
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson
2013/0281241 A1 10/2013 Watterson
2014/0024499 A1 1/2014 Watterson
2014/0073970 A1 3/2014 Ashby
2014/0121071 A1 5/2014 Strom
2014/0135173 A1 5/2014 Watterson
2014/0274574 A1 9/2014 Shorten
2014/0274579 A1 9/2014 Olson
2014/0287884 A1 9/2014 Buchanan
2014/0309085 A1 10/2014 Watterson
2015/0182779 A1 7/2015 Dalebout
2015/0182781 A1 7/2015 Watterson
2015/0238817 A1 8/2015 Watterson
2015/0250418 A1 9/2015 Ashby
2015/0251055 A1 9/2015 Ashby
2015/0253735 A1 9/2015 Watterson
2015/0253736 A1 9/2015 Watterson
2015/0258560 A1 9/2015 Ashby
2015/0290490 A1 * 10/2015 Badarneh ..... A63B 21/00076 482/57
2016/0023081 A1 * 1/2016 Popa-Simil ..... B62M 1/32 700/91
2016/0058335 A1 3/2016 Ashby
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0346595 A1 12/2016 Dalebout
2017/0036053 A1 2/2017 Smith
2017/0056711 A1 3/2017 Dalebout
2017/0056715 A1 3/2017 Dalebout
2017/0124912 A1 5/2017 Ashby
2017/0193578 A1 7/2017 Watterson
2017/0266483 A1 9/2017 Dalebout
2017/0266489 A1 9/2017 Douglass
2017/0266533 A1 9/2017 Dalebout
2017/0270820 A1 9/2017 Ashby
2018/0001135 A1 1/2018 Powell
2018/0036585 A1 2/2018 Powell
2018/0085630 A1 3/2018 Capell
2018/0089396 A1 3/2018 Capell
2018/0099116 A1 4/2018 Ashby
2018/0099179 A1 4/2018 Chatterton
2018/0099180 A1 4/2018 Wilkinson
2018/0111034 A1 4/2018 Watterson
2018/0117383 A1 5/2018 Workman
2018/0117385 A1 5/2018 Watterson
2018/0117393 A1 5/2018 Ercanbrack
2018/0154205 A1 6/2018 Watterson
2018/0154207 A1 6/2018 Hochstrasser
2018/0154209 A1 6/2018 Watterson
2018/0200566 A1 7/2018 Weston
2018/0207485 A1 * 7/2018 Sun ..... A63B 21/0058
2019/0058370 A1 2/2019 Tinney

(56) References Cited

U.S. PATENT DOCUMENTS

| | | | |
|---|---|---|---|
| 2019/0080624 | A1 | 3/2019 | Watterson |
| 2019/0151698 | A1 | 5/2019 | Olson |
| 2019/0168072 | A1 | 6/2019 | Brammer |
| 2019/0178313 | A1 | 6/2019 | Wrobel |
| 2019/0192898 | A1 | 6/2019 | Dalebout |
| 2019/0192952 | A1 | 6/2019 | Powell |
| 2019/0209893 | A1 | 7/2019 | Watterson |
| 2019/0223612 | A1 | 7/2019 | Watterson |
| 2019/0232112 | A1 | 8/2019 | Dalebout |
| 2019/0269958 | A1 | 9/2019 | Dalebout |
| 2019/0269971 | A1 | 9/2019 | Capell |
| 2019/0275366 | A1 | 9/2019 | Powell |
| 2019/0282852 | A1 | 9/2019 | Dalebout |
| 2019/0328079 | A1 | 10/2019 | Ashby |
| 2019/0329091 | A1 | 10/2019 | Powell |
| 2019/0376585 | A1 | 12/2019 | Buchanan |
| 2020/0009417 | A1 | 1/2020 | Dalebout |
| 2020/0016459 | A1 | 1/2020 | Smith |

FOREIGN PATENT DOCUMENTS

| | | |
|---|---|---|
| CN | 101365516 | 2/2009 |
| CN | 206424526 | 8/2017 |
| CN | 206434843 | 8/2017 |
| KR | 1020000054121 | 9/2000 |
| TW | 201006522 | 2/2010 |
| WO | WO 2003018391 | 3/2003 |
| WO | WO 2009034309 | 3/2009 |

OTHER PUBLICATIONS

U.S. Appl. No. 15/973,176, filed May 7, 2018, Melanie Douglass.
U.S. Appl. No. 16/742,762, filed Jan. 14, 2020, Eric W. Watterson.
U.S. Appl. No. 16/750,925, filed Jan. 25, 2019, Ryan Silcock.
U.S. Appl. No. 29/702,127, filed Sep. 16, 2019, Gordon Cutler.
U.S. Appl. No. 62/804,146, filed Feb. 11, 2019, Scott R. Watterson.
U.S. Appl. No. 62/852,118, filed May 22, 2019, David Hays
U.S. Appl. No. 62/866,576, filed Jun. 25, 2019, Rebecca Lynn Capell.
U.S. Appl. No. 62/887,391, filed Aug. 15, 2019, Gaylen Ercanbrack.
U.S. Appl. No. 62/887,398, filed Aug. 15, 2019, William T. Dalebout.
U.S. Appl. No. 62/897,113, filed Sep. 9, 2019, Megan Jane Ostler.
U.S. Appl. No. 62/914,007, filed Oct. 11, 20019, Jared Willardson.
U.S. Appl. No. 62/934,294, filed Nov. 12, 2019, William T. Dalebout.
U.S. Appl. No. 62/934,297, filed Nov. 12, 2019, William T. Dalebout.
International Search Report and Written Opinion for PCT/US2020/015092, dated May 21, 2020, 8 pages.
First Office Action in Chinese Application 202080010516.8, dated Jan. 25, 2022, 18 pages.
Office Action in Taiwanese Application 109102391, dated Aug. 24, 2020, 19 pages.
Office Action in Taiwanese Application 110108856, dated Aug. 20, 2021, 6 pages.
Extended European Search Report for EP Application Serial No. 20744319.3, dated Sep. 20, 2022, 9 pages.

* cited by examiner

SYSTEMS AND METHODS FOR AN INTERACTIVE PEDALED EXERCISE DEVICE

CROSS-REFERENCE TO RELATED APPLICATIONS

This application claims priority to provisional patent application No. 62/796,952 entitled "SYSTEMS AND METHODS FOR AN INTERACTIVE PEDALED EXERCISE DEVICE" filed Jan. 25, 2019, which application is herein incorporated by reference for all that it discloses.

BACKGROUND

Technical Field

This disclosure generally relates to pedaled exercise devices. More particularly, this disclosure generally relates to providing a plurality of directional inputs into interactive software and/or displays connected to the pedaled exercise device.

Background and Relevant Art

Cyclic motion can be very efficient power output for transportation and/or movement and is used in bicycles, tricycles, and other land-based vehicles; pedal boats and other water vehicles; and ultralight aircraft, microlight aircraft, and other aerial vehicles. Similarly, the biomechanics of the cyclic motion may produce lower impact on a user, reducing the risk of joint injury, skeletal injury, muscle injury, or combinations thereof. In contrast to other exercises such as running, cyclic motion may avoid repeated impacts on the body. Therefore, cyclic motion is a common exercise technique for fitness and/or rehabilitation. For example, elliptical running machines, stationary bicycles, handcycles, and other cyclic and/or rotary motion machines may provide resistance training or endurance training with little or no impacts upon the user's body.

SUMMARY

In some embodiments, an exercise device includes a frame, handlebars supported by the frame, and a computing device. The handlebars include a yoke that is movable relative to the frame, a biasing element positioned between the yoke and the frame, and a sensor configured to measure a movement of the yoke.

In some embodiments, an exercise device includes a frame, handlebars supported by the frame, a drivetrain supported by the frame, and a computing device. The handlebars include a yoke that is movable relative to the frame, a biasing element positioned between the yoke and the frame, and a sensor configured to measure a movement of the yoke. The drivetrain includes pedals rotatable around a pedal axis and a drivetrain sensor positioned in the drivetrain to measure movement of the pedals. The computing device is in data communication with the handlebar sensor and the drivetrain sensor.

In some embodiments, an exercise device includes a frame, handlebars supported by the frame, a drivetrain supported by the frame, a display, and a computing device. The handlebars include a yoke that is movable relative to the frame, a biasing element positioned between the yoke and the frame, and a sensor configured to measure a movement of the yoke. The drivetrain includes pedals rotatable around a pedal axis and a drivetrain sensor positioned in the drivetrain to measure movement of the pedals. The computing device is in data communication with the handlebar sensor and the drivetrain sensor, and in data communication with the display. The computing device is configured to receive directional inputs from the drivetrain sensor and the handlebar sensor and to generate visual information based partially upon the directional inputs, the visual information being displayed on the display.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 4-1 is a perspective view of a post and stem of the handlebars of FIG. 2, according to at least one embodiment of the present disclosure;

FIG. 4-2 is a perspective view of a post and stem with a quick disconnect, according to at least one embodiment of present disclosure;

FIG. 6-1 is a perspective view of the rotational mechanisms of the post and stem of FIG. 4, according to at least one embodiment of the present disclosure;

FIG. 6-2 is a perspective view of the rotational mechanisms of another post and stem, according to at least one embodiment of the present disclosure;

FIG. 6-3 is a perspective view of the rotational mechanisms of yet another post and stem, according to at least one embodiment of the present disclosure;

FIG. 6-4 is a perspective view of the rotational mechanisms of a further post and stem, according to at least one embodiment of the present disclosure;

FIG. 6-5 is a perspective view of the rotational mechanisms of a yet further post and stem, according to at least one embodiment of the present disclosure;

FIG. 8-1 is a perspective view of the drivetrain of the interactive exercise device of FIG. 7, according to at least one embodiment of the present disclosure;

FIG. 8-2 is a detail view of a drivetrain sensor, according to at least one embodiment of the present disclosure;

FIG. 8-3 is a detail view of another drivetrain sensor, according to at least one embodiment of the present disclosure;

DETAILED DESCRIPTION

In some embodiments of an interactive exercise device according to the present disclosure, an exercise device may allow a user to input a plurality of directional inputs to an interactive software. As described herein, an exercise device may receive directional inputs to change images displayed on a display in communication with the exercise device to provide feedback and entertainment to a user during exercise.

Figure 1:
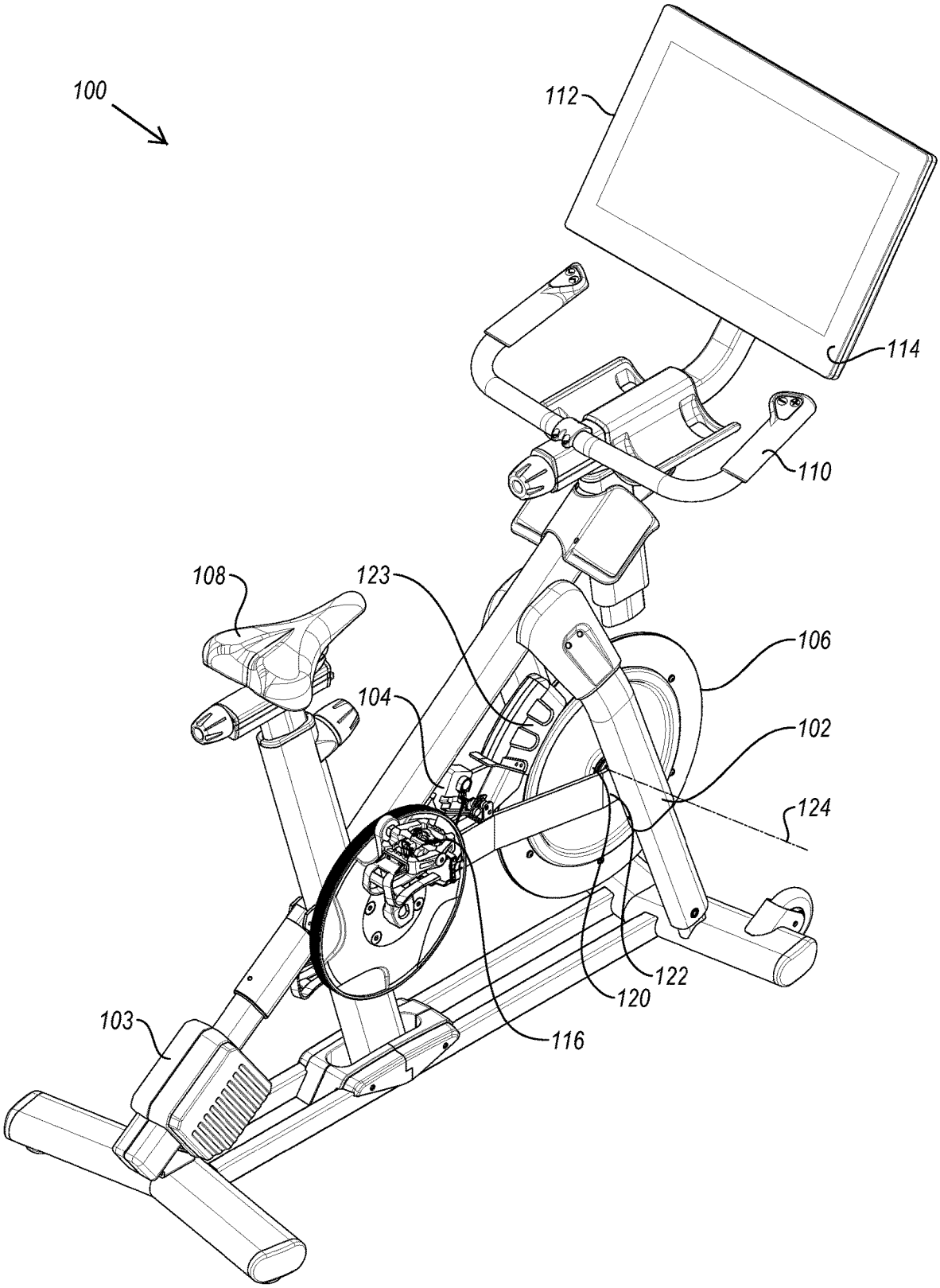
FIG. 1 is a perspective view of an interactive exercise device, according to at least one embodiment of the present disclosure.

FIG. 1 is a perspective view of an embodiment of an exercise bicycle 100, according to the present disclosure. The exercise bicycle 100 may include a frame 102 that supports a drivetrain 104 and at least one wheel 106. The frame 102 may further support a seat 108 for a user to sit upon, handlebars 110 for a user to grip, one or more displays 112, or combinations thereof. In some embodiments, the display 112 is supported by the frame 102. In other embodiments, the display 112 is separate from the frame 102, such as a wall-mounted display. In yet other embodiments, the display 112 is a head-mounted display (HMD) worn by the user, such as a virtual reality, mixed reality, or augmented reality HMD. In further embodiments, a combination of displays 112 may be used. For example, one or more of a display 112 that is supported by the frame 102, a display 112 that is separate from the frame 102, and a HMD may be used.

In some embodiments, an exercise bicycle 100 may use one or more displays 112 to display feedback or other data regarding the operation of the exercise bicycle 100. In some embodiments, the drivetrain 104 and/or handlebars 110 may be in data communication with the display 112 (via a computing device 114) such that the display 112 presents real-time information or feedback collected from one or more sensors on the drivetrain 104 and/or handlebars 110. For example, the display 112 may present information to the user regarding cadence, wattage, simulated distance, duration, simulated speed, resistance, incline, heart rate, respiratory rate, other measured or calculated data, or combinations thereof. In other examples, the display 112 may present use instructions to a user, such as workout instructions for predetermined workout regimens (stored locally or accessed via a network); live workout regimens, such as live workouts broadcast via a network connection; or simulated bicycle rides, such as replicated stages of real-world bicycle races. In yet other examples, the display 112 may present one or more entertainment options to a user during usage of the exercise bicycle 100.

The display 112 may display locally stored videos and/or audio, video and/or audio streamed via a network connection, video and/or audio received from a connected device (such as a smartphone, laptop, or other computing device connected to the display 112), dynamically generated images using a connected or integrated device, or other entertainment sources. In other embodiments, an exercise bicycle 100 may lack a display 112 on the exercise bicycle, and the exercise bicycle 100 may provide information to an external or peripheral display or computing device. For example, the exercise bicycle 100 may communicate with one or more of a smartphone, wearable device, tablet computer, laptop, or other electronic device to allow a user to log their exercise information.

The exercise bicycle 100 may have a computing device 114 in data communication with one or more components of the exercise bicycle 100. For example, the computing device 114 may allow the exercise bicycle 100 to collect information from the drivetrain 104 and display such information in real-time. In other examples, the computing device 114 may send a command to activate one or more components of the frame 102 and/or drivetrain 104 to alter the behavior of the exercise bicycle 100. For example, the frame 102 may move to simulate an incline or decline displayed on the display 112 during a training session by tilting the frame 102 with a tilt motor 103. Similarly, the drivetrain 104 may change to alter resistance, gear, or other characteristics to simulate different experiences for a user. The drivetrain 104 may increase resistance to simulate climbing a hill, riding through sand or mud, and/or another experience that requires greater energy input from the user, and/or the drivetrain 104 may change gear (e.g., physically or "virtually") and the distance calculated by the computing device 114 may reflect the selected gear.

In some embodiments, the handlebars 110 are movable relative to the frame 102. The user may move the handlebars 110 relative to the frame 102 to provide directional inputs to the computing device 114. For example, the display 112 may present images to the user of a dynamically-generated virtual or mixed environment, such as used in a computer game. The images of the virtual environment may change as the user provides directional inputs via the drivetrain 104 (e.g., by pedaling) and/or the handlebars 110 (e.g., by tilting or moving the handlebars 110 relative to the frame 102).

In some examples, the handlebars 110 include one or more sensors, such as accelerometers, gyroscopes, pressure sensors, or other sensors, that measure the movement and/or position of the handlebars 110. In some embodiments, the sensors measure the movement and/or position of the handlebars 110 relative to the frame 102. In further embodiments, the sensors measure the movement and/or position of the handlebars 110 relative to an initial position in space. In yet further embodiments, the sensors measure the movement and/or position of the handlebars 110 relative to the direction of gravity.

In some embodiments, the sensors measure the movement and/or position of the handlebars 110 and/or drivetrain 104 with a sampling rate in a range having an upper value, a lower value, or upper and lower values including any of 30

Hertz (Hz), 45 Hz, 60 Hz, 75 Hz, 90 Hz, 120 Hz, 150 Hz, 180 Hz, 210 Hz, 240 Hz, or any values therebetween. For example, the sampling rate may be greater than 30 Hz. In other examples, the sampling rate may be less than 240 Hz. In yet other examples, the sampling rate may be between 30 and 240 Hz. In further examples, the sampling rate may be between 60 and 120 Hertz. In at least one example, the sampling rate is about 65 Hz.

In some embodiments, the drivetrain 104 and/or handlebars 110 may be in data communication with the display 112 such that the drivetrain 104 and/or handlebars 110 may change and/or move to simulate one or more portions of an exercise experience. The display 112 may present an incline to a user and the drivetrain 104 may increase in resistance to reflect the simulated incline. In at least one embodiment, the display 112 may present an incline to the user and the frame 102 may incline and the drivetrain 104 may increase resistance simultaneously to create an immersive experience for a user. In other embodiments, the display 112 may display a curve in a road or track, and the handlebars 110 may tilt or move around a rotational axis relative to the frame 102 to simulate leaning or movement of the exercise bicycle 100. In other words, the display 112 and the exercise bicycle 100 may be synchronized to simulate actual riding conditions.

The computing device 114 may allow tracking of exercise information, logging of exercise information, communication of exercise information to an external electronic device, or combinations thereof with or without a display 112. For example, the computing device 114 may include a communications device that allows the computing device 114 to communicate data to a third-party storage device (e.g., internet and/or cloud storage) that may be subsequently accessed by a user.

In some embodiments, the drivetrain 104 may include an input component that receives an input force from the user and a drive mechanism that transmits the force through the drivetrain 104 to a hub that moves a wheel 106. In the embodiment illustrated in FIG. 1, the input component is a set of pedals 116 that allow the user to apply a force to a belt. The belt may rotate an axle 120 about a wheel axis 124. The rotation of the axle 120 may be transmitted to a wheel 106 by a hub 122. In some embodiments, the wheel 106 may be a flywheel.

In some embodiments, the computing device 114 receives information from the drivetrain 104 and/or alter the drivetrain 104 as the user "moves" in a virtual or mixed environment. For example, the hub 122 may alter the resistance of the drivetrain 104 in response to the user moving in a virtual environment. In a particular example, the user may move the handlebars to provide a directional input upward, and the drivetrain 104 may increase resistance on the pedals 116 to simulate pedaling upward. For safety purposes, a brake 123 may be positioned on or supported by the frame 102 and configured to stop or slow the wheel 106 or other part of the drivetrain 104.

In some embodiments, the brake 123 may be a friction brake, such as a drag brake, a drum brake, a caliper brake, a cantilever brake, or a disc brake, that may be actuated mechanically, hydraulically, pneumatically, electronically, by other means, or combinations thereof. In other embodiments, the brake 123 may be a magnetic brake that slows and/or stops the movement of the wheel 106 and/or drivetrain 104 through the application of magnetic fields. In some examples, the brake may be manually forced in contact with the wheel 106 by a user rotating a knob to move the brake 123. In other examples, the brake 123 may be a disc brake with a caliper hydraulically actuated with a lever on the handlebars 110. In yet other examples, the brake may be actuated by the computing device 114 in response to one or more sensors.

Figure 2:
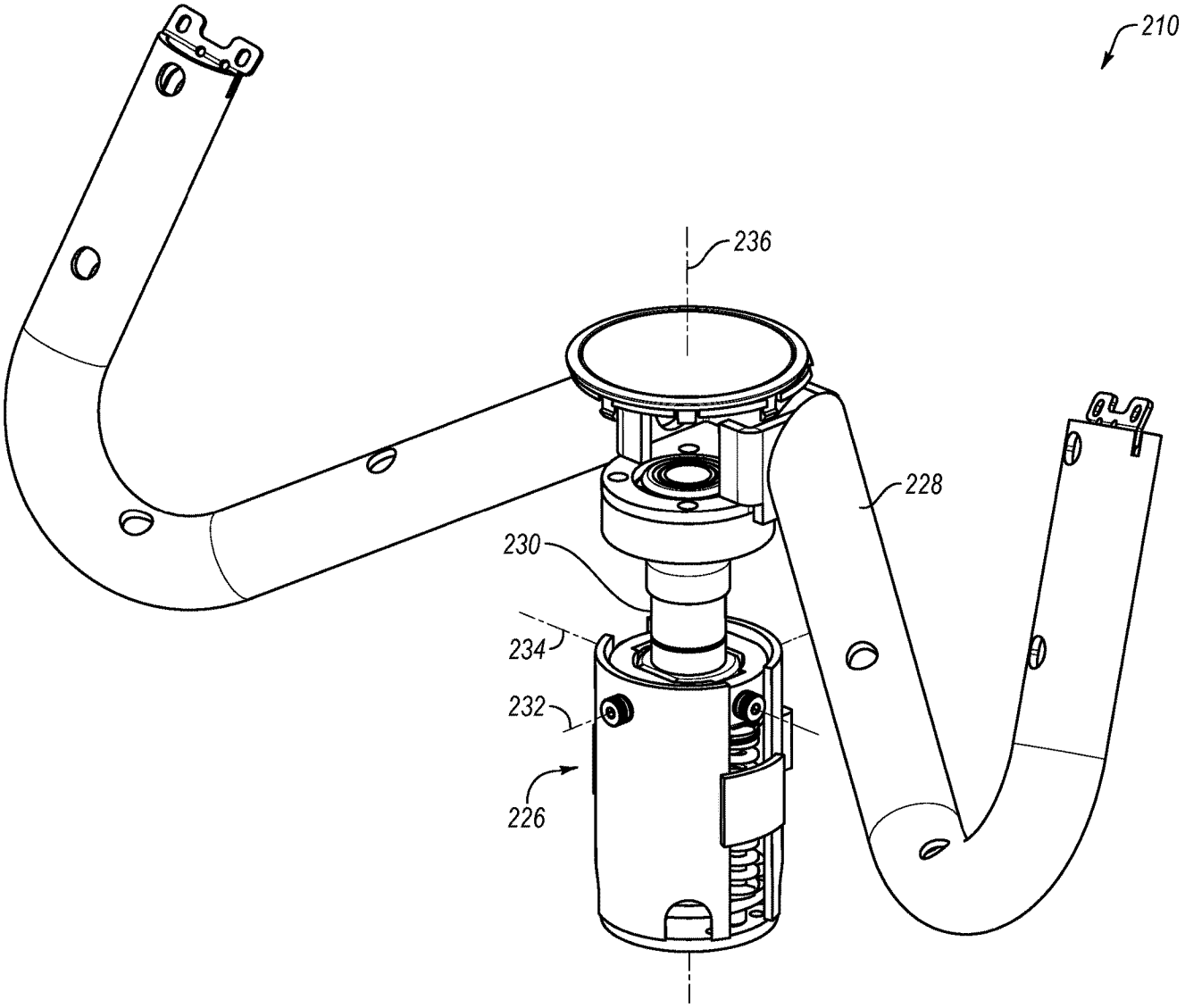
FIG. 2 is a perspective view of handlebars of an interactive exercise device, according to at least one embodiment of the present disclosure.

FIG. 2 is a detail view of an embodiment of handlebars 210 and a supporting post 226 that allows movement of the handlebars 210. The post 226 may be fixed relative to the frame of the exercise bicycle or other exercise device, such that movement of the handlebars 210 relative to the post 226 moves the handlebars 210 relative to the frame. The handlebars 210 include a yoke 228 supported by a stem 230. The stem 230 is connected to the post 226 by a movable connection.

In the illustrated embodiment, the post 226 has a two-axis movable connection. For example, the yoke 228 and stem 230 may move relative to the post 226 around a first axis 232 and a second axis 234 oriented orthogonally to the first axis 232. The first axis 232 may be a longitudinal axis of the frame and the second axis 234 may be a lateral axis of the frame. In such examples, rotation of the yoke 228 around the first axis 232 tilts the yoke 228 laterally (i.e., left and right) relative to the post 226 and frame while rotation of the yoke 228 around the second axis 234 tilts the yoke 228 longitudinally (i.e., forward and rearward) relative to the post 226 and frame. In other examples, the yoke 228 may rotate about a vertical third axis 236, allowing twisting of the yoke 228 in the direction of the stem 230 and/or post 226.

Figure 3:
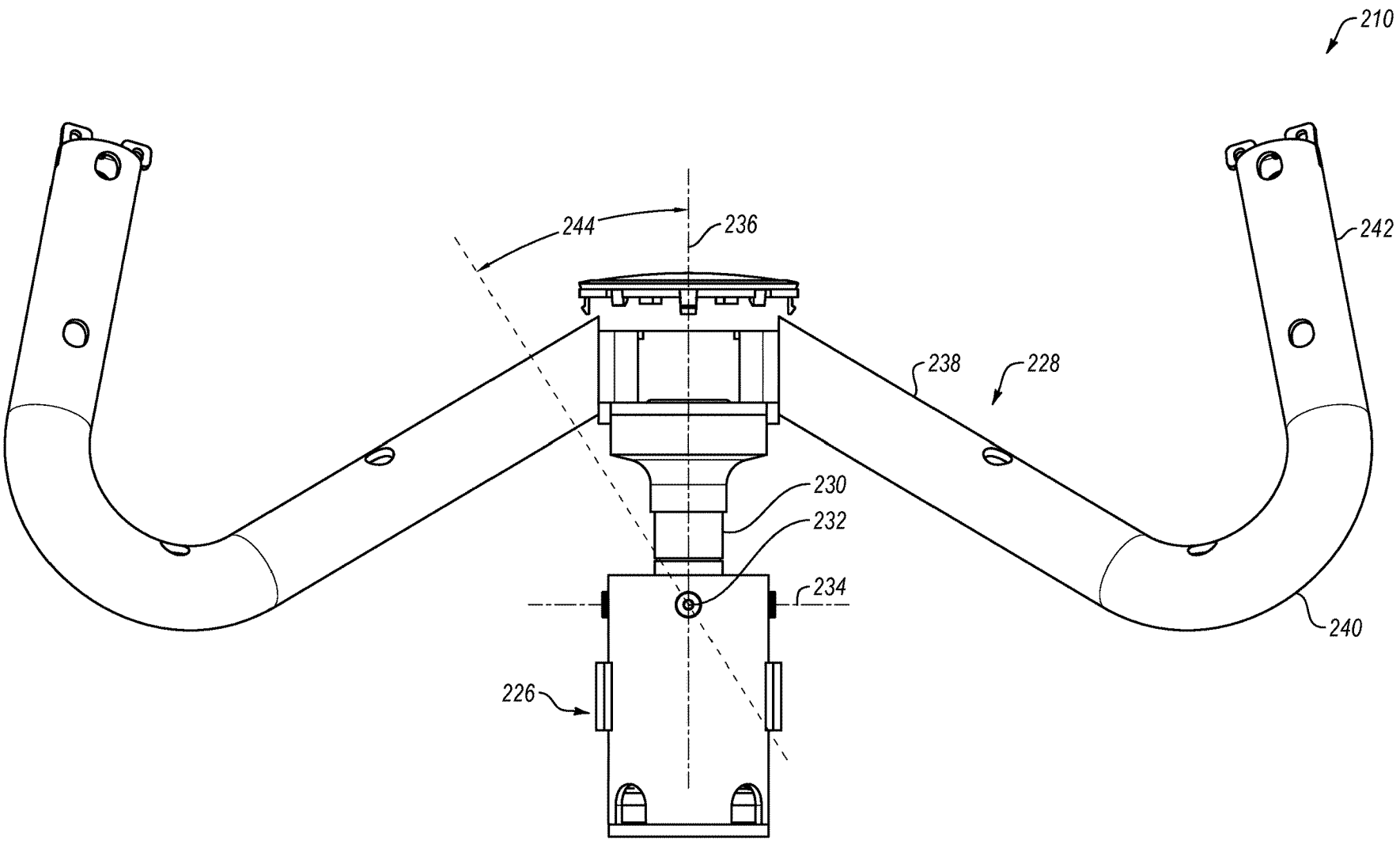
FIG. 3 is a front view of handlebars of an interactive exercise device, according to at least one embodiment of the present disclosure.

FIG. 3 is a side view of the handlebars 210 of FIG. 2. In some embodiments, the yoke 228 is a curved yoke 228. For example, the illustrated embodiment shows a yoke 228 with a lower portion 238 near the stem 230 and an upward curved portion 240 that terminates in an upper handle 242. In another example, a curved yoke 228 may have a downward curving portion, such as drop handlebars common to road bicycles, with a lower handle. In other embodiments, the yoke 228 is a flat yoke. For example, the yoke 228 may be approximately straight from one end to the other or approximately straight between the stem 230 and an end of the yoke 228. In yet other embodiments, the yoke 228 is a flat yoke 228 with bar end grips. For example, the yoke 228 may be a flat bar with bar end grips that extend upward from the flat bar.

The yoke 228 and stem 230 rotate around the first axis 232 and second axis 234. In some embodiments, the range of motion around the first axis 232 and the range of motion around the second axis 234 are the same. In other embodiments, the range of motion around the first axis 232 is greater than the range of motion around the second axis 234. In yet other embodiments, the range of motion around the first axis 232 is less than the range of motion around the second axis 234.

The range of motion 244 of the yoke 228 relative to the post 226 around either the first axis 232, the second axis 234, or the third axis 236 in each direction is in a range having an upper value, a lower value, or upper and lower values including any of 5°, 10°, 20°, 30°, 40°, 50°, 60°, 70°, 80°, 90°, or any values therebetween. For example, the range of motion 244 from a centerpoint around the first axis 232, the second axis 234, or the third axis 236 may be greater than 5° in each direction. In other examples, the range of motion 244 around the first axis 232, the second axis 234, or the third axis 236 may be less than 90°. In yet other examples, the range of motion 244 around the first axis 232, the second axis 234, or the third axis 236 may be between 5° and 90°. In further examples, the range of motion 244 around the first axis 232, the second axis 234, or the third axis 236 may be between 20° and 70°. In yet further examples, the range of motion 244 around the first axis 232, the second axis 234, or the third axis 236 may be between 30° and 60°. In at least one example, it may be critical that the range of motion 244 around the first axis 232, the second axis 234, or the third axis 236 in each direction is at least 45°.

In other embodiments, the yoke 228 may be movable relative to the post 226 in a linear fashion. For example, the yoke 228 may translate in a direction of the first axis 232, the second axis 234, the third axis 236, or any direction therebetween. In a particular example, the stem 230 may telescope in the direction of the third axis 236, such that the yoke 228 can be pushed or pulled relative to the post 226. In some embodiments, the translational axis (e.g., the third axis 236) may tilt with the yoke 228 and stem 230, allowing the yoke 228 to be pushed or pulled relative to the post 226 while the yoke 228 is rotated relative to the post 226.

Figures 1, 4:
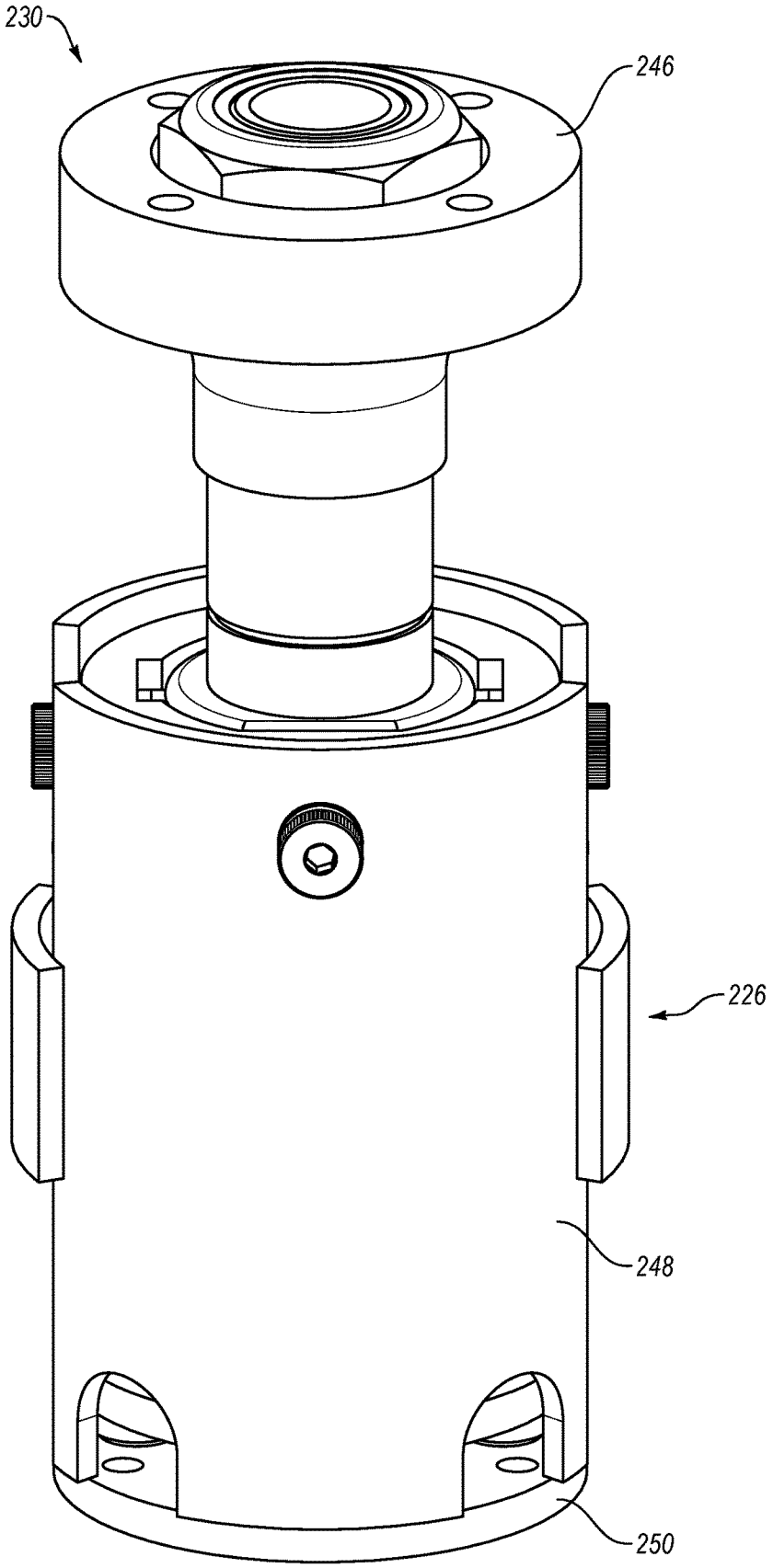
Figures 2, 4:
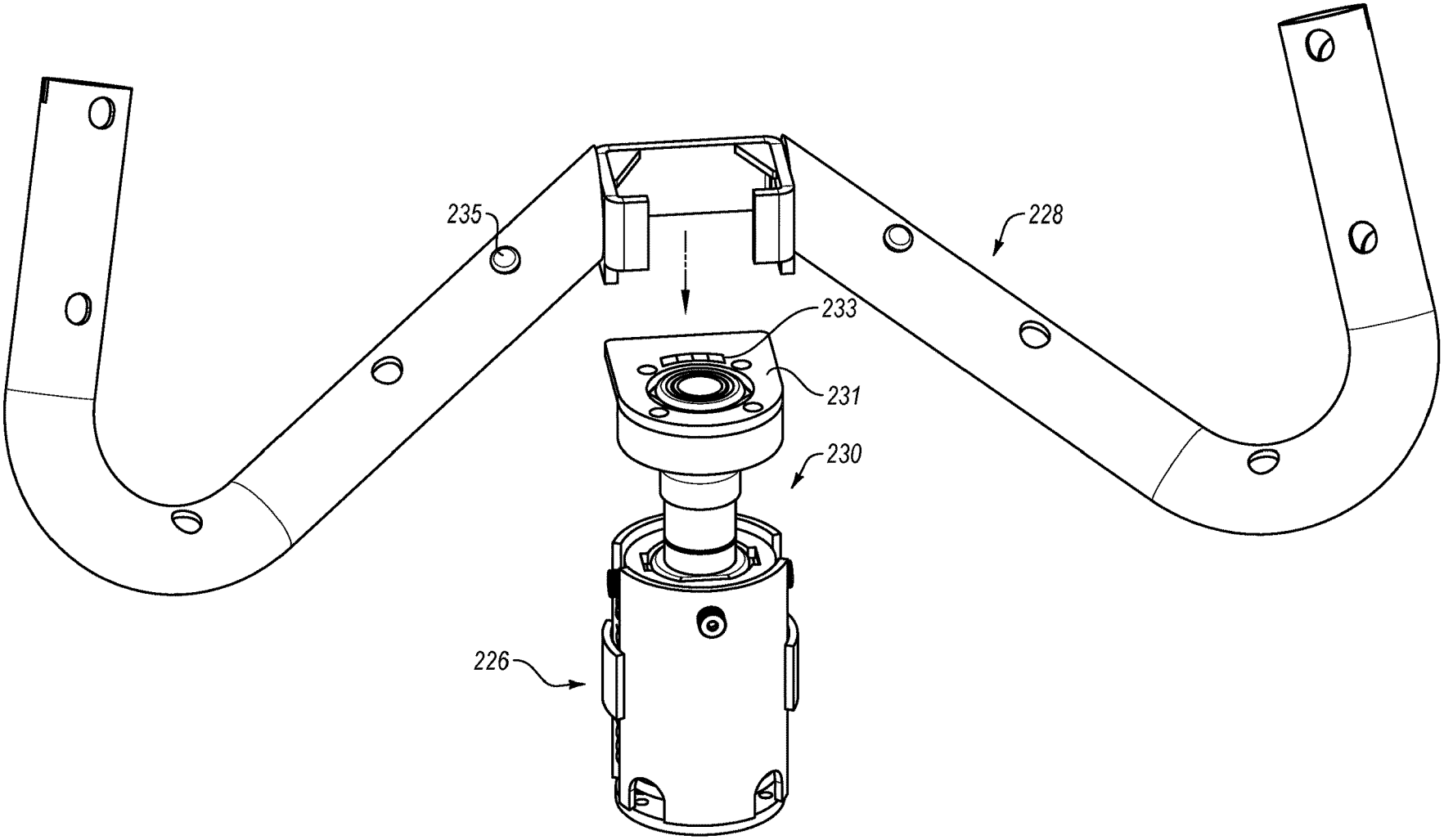

FIG. 4-1 is a detail view of the embodiment of a post 226 and stem 230 of FIG. 3. The stem 230 has a mounting bracket 246 that connects the yoke to the stem 230. In some embodiments, the mounting bracket 246 fixes the yoke relative to the stem 230. In other embodiments, the mounting bracket 246 allows movement of the yoke relative to the stem 230 in at least one direction. For example, the mounting bracket 246 may include race bearings to allow rotation of the yoke relative to the stem 230.

In some embodiments, the post 226 has a housing 248 and a bottom plate 250. The bottom plate 250 may be fastened or connected to the housing 248 to enclose the post 226. In other examples, the bottom plate 250 may be a part of a frame or other portion of an exercise device to which the post 226 is connected. The housing 248 and/or bottom plate 250 may allow one or more biasing members to be positioned at least partially inside the post 226 to bias and/or dampen the movement of the stem 230 and/or yoke during usage.

In some embodiments, the yoke may be interchangeable with a selection of yokes to allow customization of the exercise device to a user's preferences or to the different requirements of an exercise or entertainment system. FIG. 4-2 is a perspective view of an embodiment of a stem 230 with a connection plate 231. The post 226 may retain all of the functionalities described herein, while the yoke 228 is easily changed between different styles or configurations. For example, the yoke 228 of FIG. 4-2 contains a plurality of buttons 235 or other input controls positioned on the yoke 228. The connection plate 231 has electrical contacts 233 that allow the buttons 235 of the yoke 228 to communicate with the post 226. When the yoke 228 is changed to a second yoke with a different configuration, the second yoke may communicate with the post 226 via the electrical contacts 233, also, simplifying the customization of the handlebars.

Figure 5:
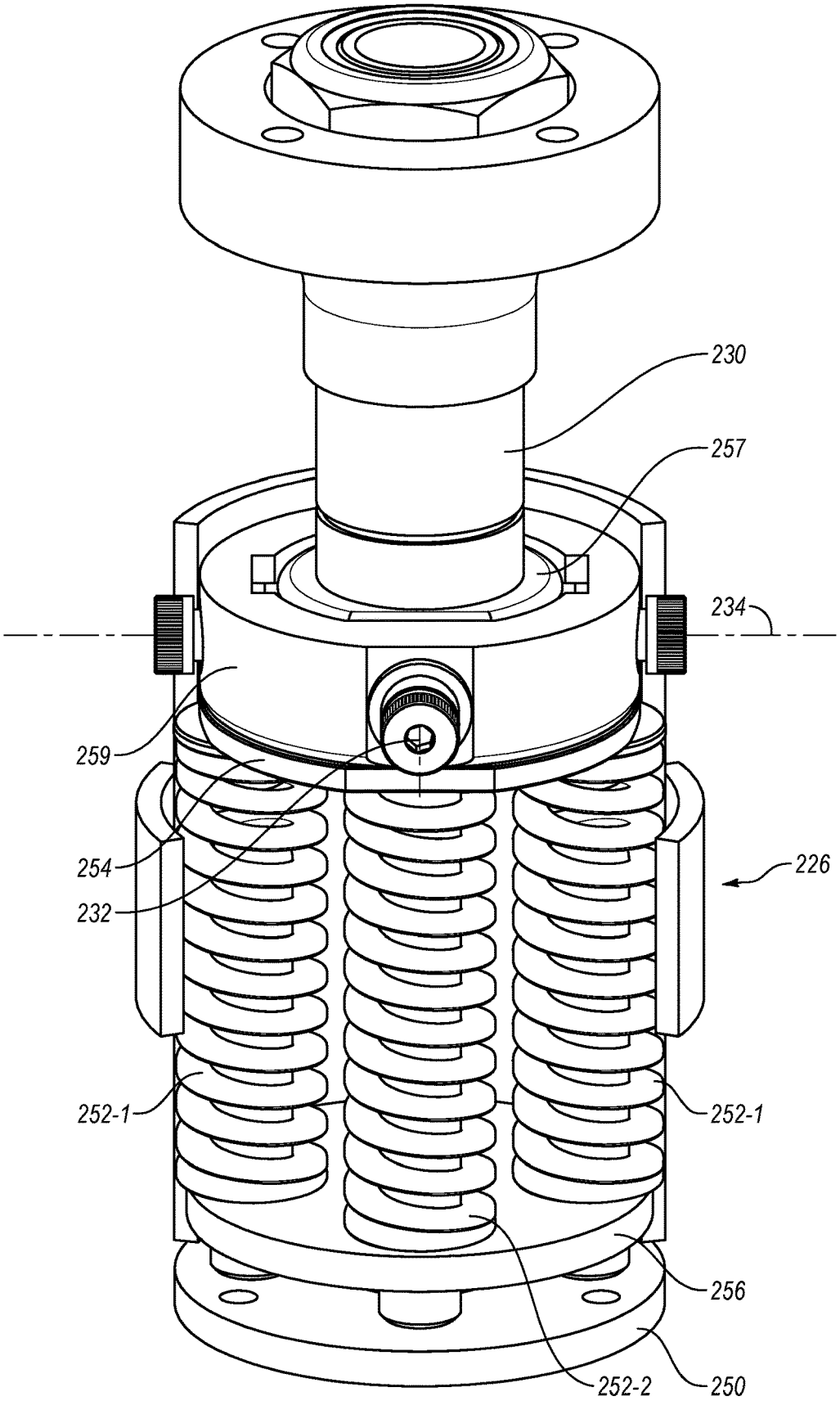
FIG. 5 is a perspective view of biasing elements of the post and stem of FIG. 4, according to at least one embodiment of the present disclosure.

FIG. 5 is a perspective view of the post 226 of FIG. 4-1 with the housing removed. The post 226 includes biasing elements 252-1, 252-2 that bias the stem 230 toward a centered position relative to the post 226. In some embodiments, the centered position is coaxial with or in line with the post 226. In other embodiments, the centered position is oriented at an angle to the post 226. The centered position is, in either case, a stable position to which the stem 230 and yoke return, relative to the post 226, when a user removes an applied force or other input from the yoke and stem 230.

The stem 230 can move from the centered position around the first axis 232 and/or second axis 234 as a user applies a force to the yoke and stem 230. The biasing elements 252-1, 252-2 can resist the rotation of the stem 230 around the first axis 232 and/or second axis 234 and bias the stem 230 back toward the centered position. In some examples, the post 226 has at least one first biasing element 252-1 that biases the stem 230 in relation to the first axis 232. In other examples, the post 226 has a plurality of first biasing elements 252-1 that work in concert to bias the stem 230 toward a centered position around the first axis 232. The first biasing elements 252-1 may be positioned on either side of a contact plate 254 at the top of the post 226 opposite one another. For example, the first biasing elements 252-1 may be mirrored about an axis, plane, or another biasing element or other component of the post 226. In some embodiments, the first biasing element 252-1 includes a spring. In other embodiments, the first biasing element 252-1 includes a piston and cylinder. In other embodiments, the first biasing element 252-1 includes a bushing.

In some examples, the post 226 has at least one second biasing element 252-2 that biases the stem 230 in relation to the second axis 234. In other examples, the post 226 has a plurality of second biasing elements 252-2 that bias the stem 230 in relation to the second axis 234. The second biasing elements 252-2 may be positioned on either side of a contact plate 254 at the top of the post 226 opposite one another. In some embodiments, the second biasing elements 252-2 include a spring. In other embodiments, the second biasing elements 252-2 include a piston and cylinder. In other embodiments, the second biasing elements 252-2 include a bushing.

The first biasing elements 252-1 and second biasing elements 252-2 apply a force between the contact plate 254 and an opposite base plate 256. In some embodiments, the base plate 256 may be the same as the bottom plate 250. In other embodiments, the base plate 256 may be different from the bottom plate 250. In at least one example, the base plate 256 may be movable relative to the bottom plate 250 to adjust the preload and/or damping of the biasing elements 252-1, 252-2.

In some embodiments, the contact plate 254 contacts an inner ring 257 of the stem 230 and an outer ring 259 of the stem 230. The outer ring 259 may be rotatable around the first axis 232 and the inner ring 257 may be rotatable around the second axis 234.

Figures 1, 6:
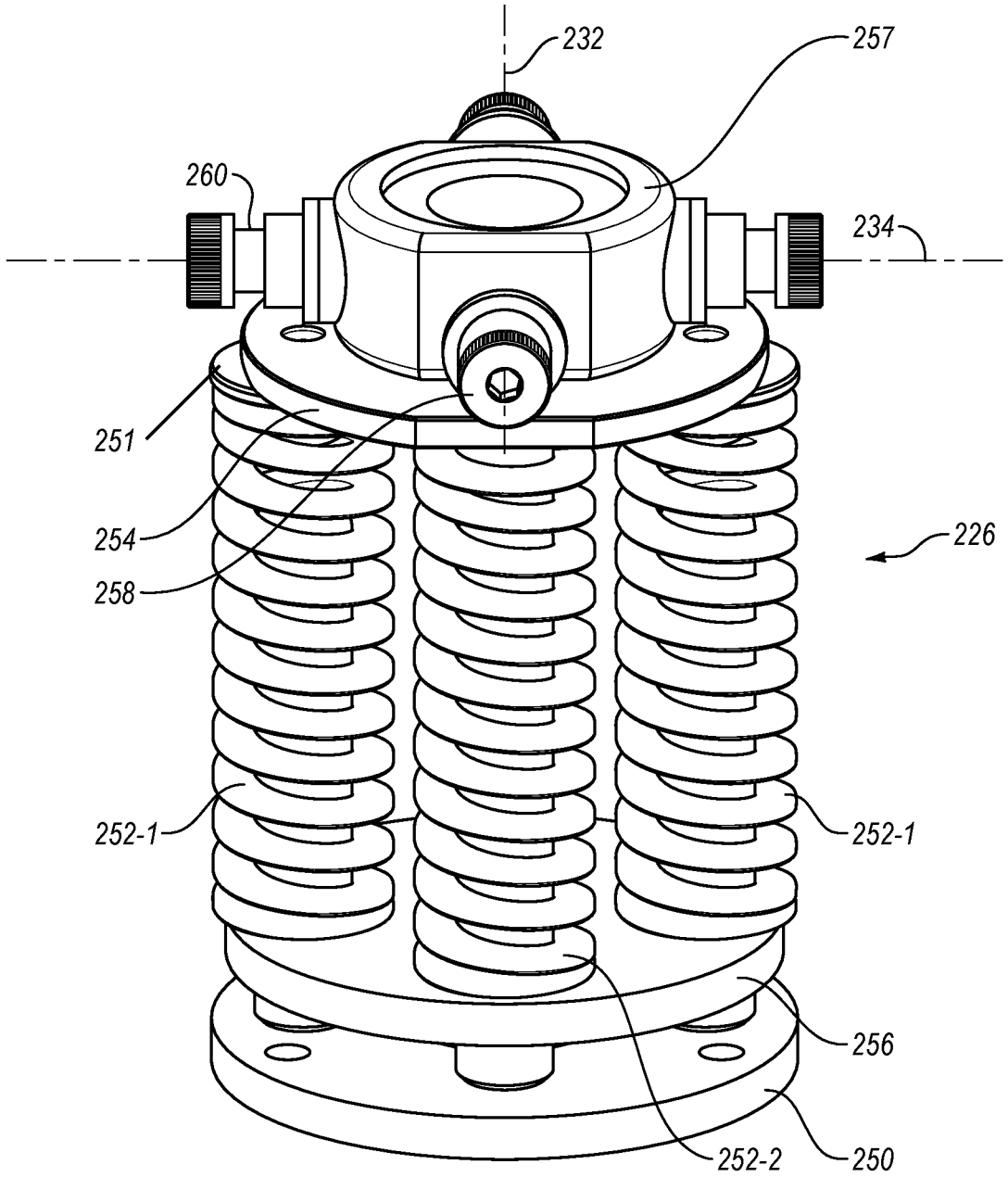
Figures 3, 6:
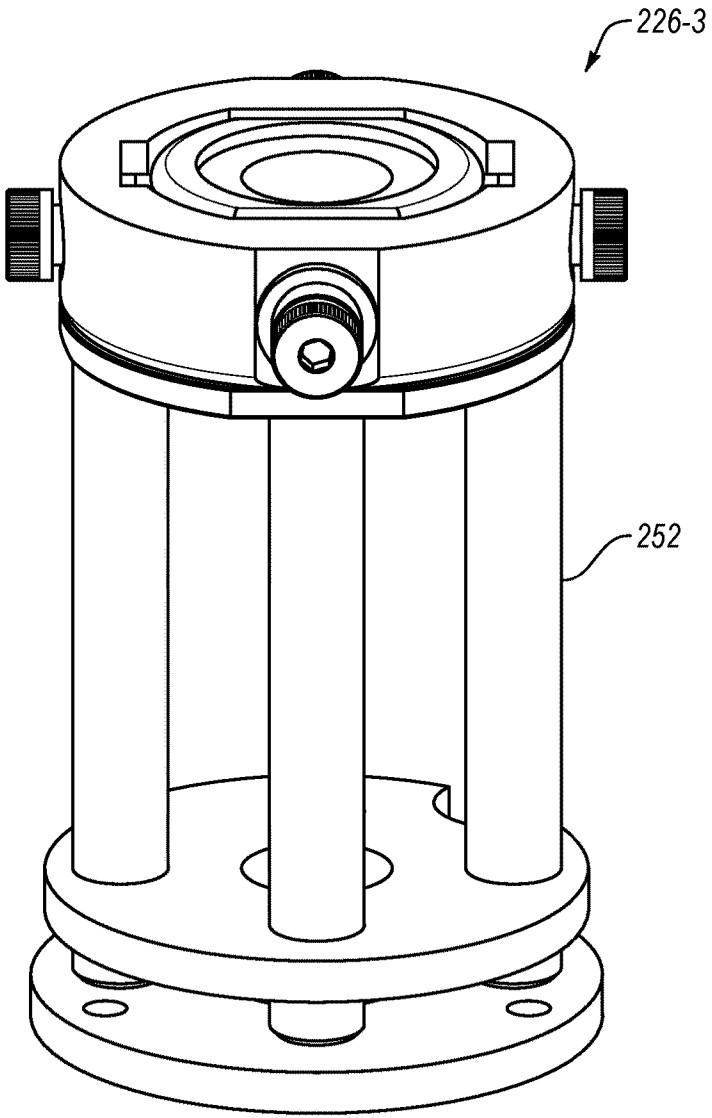
Figures 2, 6:
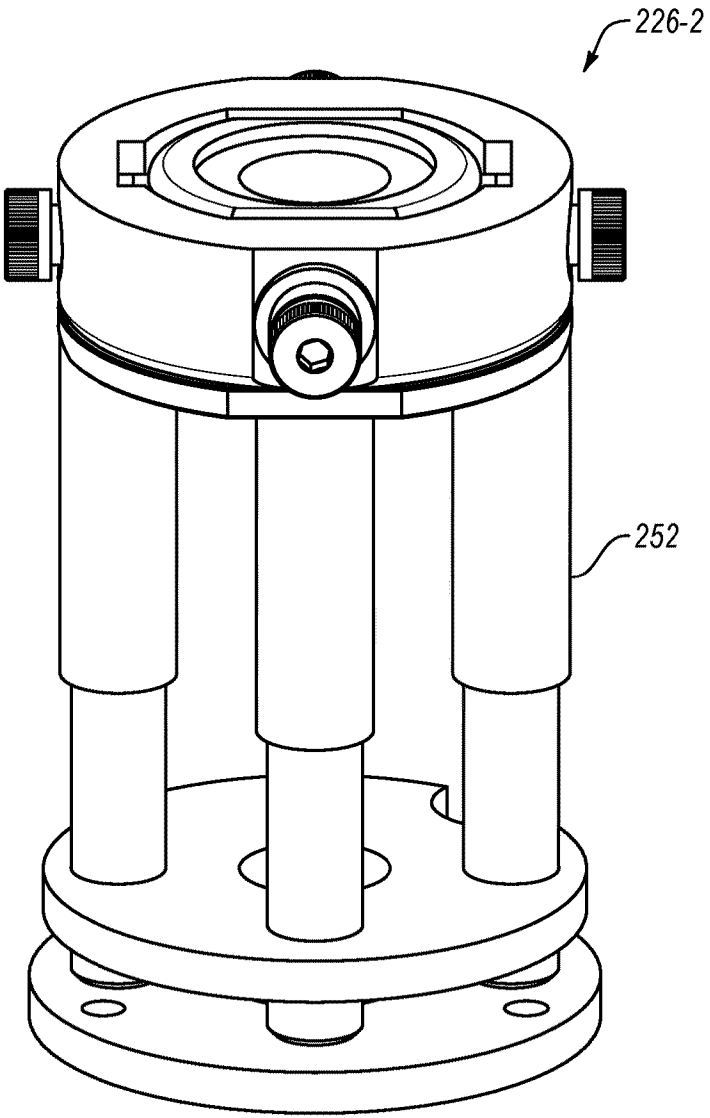
Figures 5, 6:
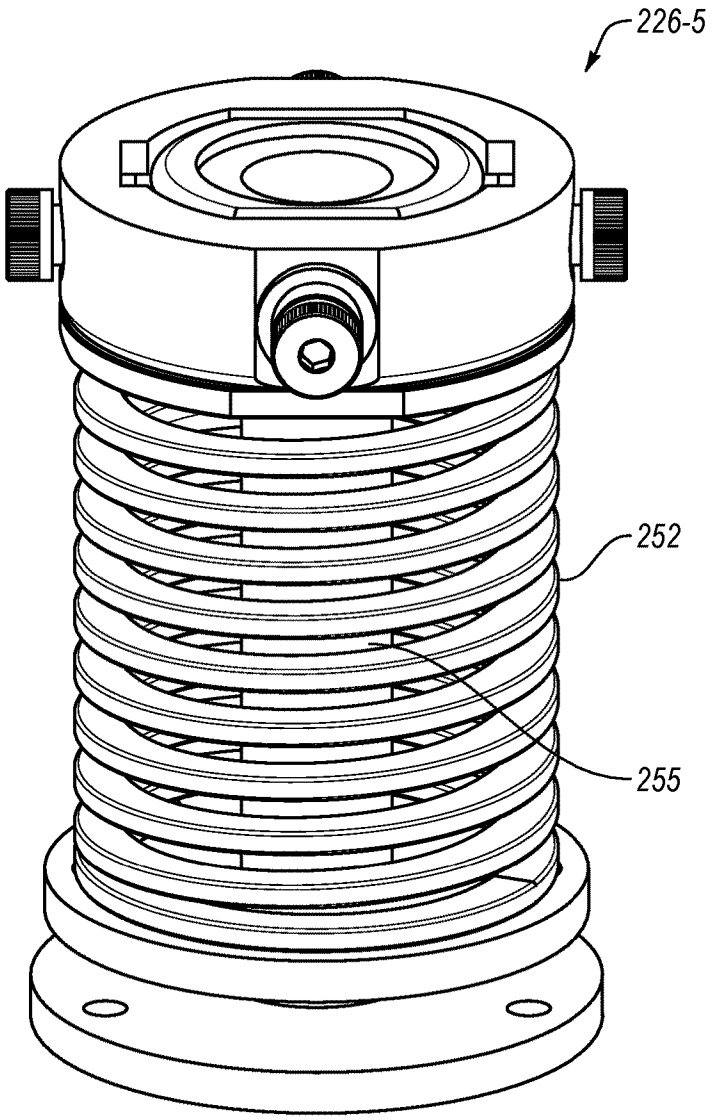
Figures 4, 6:
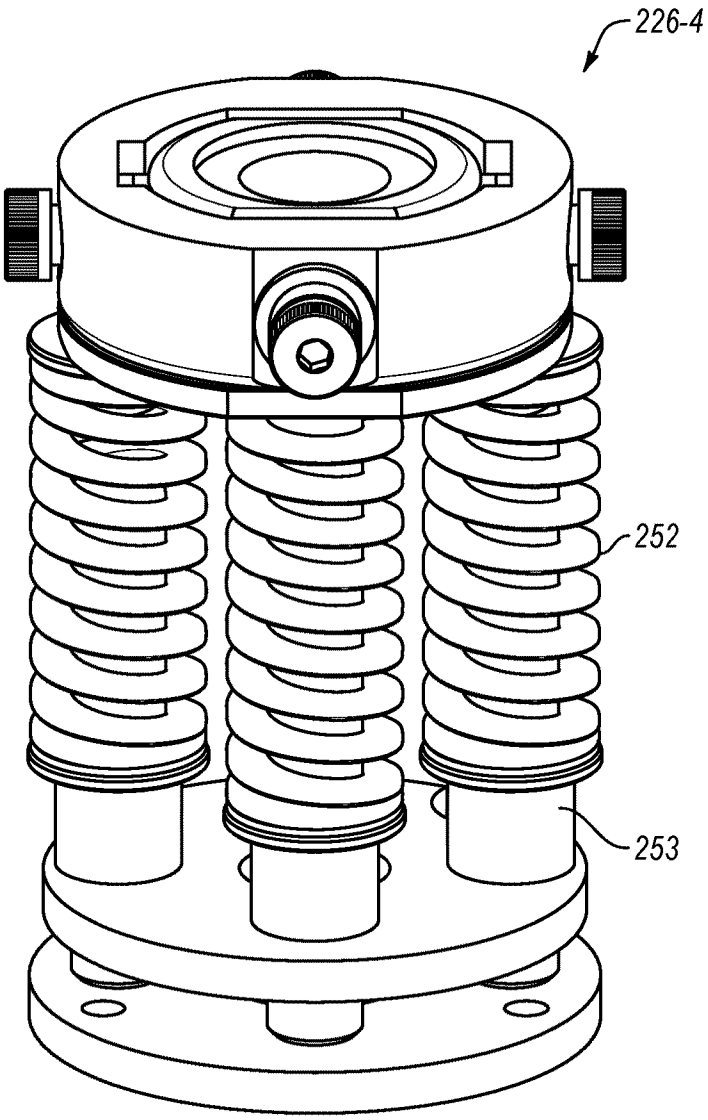

FIG. 6-1 shows the post 226 and a portion of the stem with the outer ring removed from the inner ring 257. The outer ring and inner ring 257 are supported by a first axle 258 and a second axle 260, respectively. The first axle 258 allows rotation around the first axis 232 and the second axle 260 allows rotation around the second axis 234.

As described herein, the post 226 and/or stem contains at least one sensor to measure the movement and/or position of the stem and yoke. In some embodiments, the contact plate 254 and/or the base plate 256 include a pressure sensor that measures changes in the force applied by the first biasing elements 252-1 and the second biasing elements 252-2 during movement of the yoke. In other embodiments, the contact plate 254 and/or the base plate 256 include an accelerometer or gyroscope that measures the movement and/or position of the yoke.

In some embodiments, the first biasing elements 252-1 and/or second biasing elements 252-2 may have equal spring constants. In other words, the first biasing elements 252-1 and/or second biasing elements 252-2 may each produce an equal restorative force in response to compression and/or extension of the first biasing elements 252-1 and/or second biasing elements 252-2. In other embodiments, the biasing elements may have different spring constants to customize the user's experience and/or to allow directional inputs to be entered more easily in certain directions.

For example, the embodiment of first biasing elements 252-1 and/or second biasing elements 252-2 illustrated in FIG. 6-1 include four biasing elements oriented at four positions relative to a user. For the purposes of description, the four positions may be North and South (second biasing elements 252-2 opposing one another) and East and West (first biasing elements 252-1 opposing one another). In some examples, the East and West biasing elements may be equal, providing equal resistance to rotation toward the left and right from a user's perspective. In some examples, the East and West biasing elements may be unequal to compensate for a dominant hand of the user, such as a right-handed user applying greater force on the East biasing element that the West biasing element.

In other examples, the North and South biasing elements may be equal, providing equal resistance to rotation fore and aft from a user's perspective. In some examples, the North and South biasing elements may be unequal to compensate for the unequal leverage that may be applied by a user leaning over the handlebars. In such examples, the South biasing element nearest the user may have a greater spring constant to provide greater resistance, as a user may have greater leverage to push the bottom of the yoke downward. For example, the North and South biasing elements (e.g., the second biasing elements 252-2) may have a spring constant ratio between 1:4 (i.e., the South biasing element has a spring constant four times greater than the North biasing element) and 9:10 (the North biasing element has a spring constant that is 90% of the South biasing element). In another example, the spring constant ratio may about 2:3.

In some embodiments, the spring constant of the first biasing elements 252-1 and/or second biasing elements 252-2 may be in a range having an upper value a lower value, or upper and lower values including any of 50 pounds per inch (lb/in), 75 lb/in, 100 lb/in, 125 lb/in, 150 lb/in, 175 lb/in, 200 lb/in, or any values therebetween. For example, a spring constant of at least one of the first biasing elements 252-1 and/or second biasing elements 252-2 may be greater than 50 lb/in. In other examples, the spring constant of at least one of the first biasing elements 252-1 and/or second biasing elements 252-2 may be less than 200 lb/in. In yet other examples, the spring constant of at least one of the first biasing elements 252-1 and/or second biasing elements 252-2 may be between 50 lb/in and 200 lb/in. In further examples, the spring constant of at least one of the first biasing elements 252-1 and/or second biasing elements 252-2 may be between 75 lb/in and 175 lb/in. In yet further examples, the spring constant of at least one of the first biasing elements 252-1 and/or second biasing elements 252-2 may be between 100 lb/in and 150 lb/in. In at least one example, the spring constant the North, East, and West biasing elements may be about 100 lb/in and the South biasing element (nearest the user) may be about 150 lb/in.

The first biasing elements 252-1 and/or second biasing elements 252-2 may be in contact with and apply a force to the contact plate 254. In other examples, an end cap 251 may be positioned on an end of the first biasing elements 252-1 and/or second biasing elements 252-2 and between the first biasing elements 252-1 and/or second biasing elements 252-2 and the contact plate 254. The end cap 251 may allow the end of the first biasing elements 252-1 and/or second biasing elements 252-2 to slide relative to the contact plate 254 as the contact plate 254 moves with the stem and/or yoke. The end cap 251 may, therefore, reduce wear on the first biasing elements 252-1 and/or second biasing elements 252-2 and the contact plate 254, increasing the operational lifetime of the exercise device.

While FIG. 6-1 illustrates an embodiment of first biasing elements 252-1 and/or second biasing elements 252-2 including coil springs, other biasing elements may be used. For example, FIG. 6-2 illustrates another embodiment of a post 1226-2 with biasing elements 252 including a piston and cylinder with a compressible fluid therein. While both coil springs and a piston and cylinder with a compressible fluid can provide a restoring expansive force when compressed, the force curve of the restorative force relative to amount of compression may be different, providing a different haptic and tactile experience for a user.

Similarly, FIG. 6-3 illustrates another embodiment of a post 226-3 with biasing elements 252 including elastic tensile bands. The tensile bands provide little to no restorative force in response to compression (due to movement of a stem and/or yoke). However, biasing elements 252 including tensile bands can provide a restorative force in response to extension of the biasing elements 252, providing another option for a haptic and tactile experience for a user.

FIG. 6-4 is a perspective view of another embodiment of a post 226-4 with biasing elements 252 and actuatable elements 253. The biasing elements 252 provide a restorative force as a user moves a yoke of the handlebars, and the actuatable elements 253 may apply a force to move the yoke and/or to preload the biasing elements 252. For example, the actuatable elements 253 may be motors, solenoids, piston and cylinders or other selectively moveable elements that move in the direction of the biasing elements 252. The actuatable elements 253 can apply a compressive force to the biasing elements 252, which may in turn apply a force to move the yoke. In other examples, the actuatable elements 253 can apply a compressive force to the biasing elements 252 to preload the biasing elements 252. A preloaded biasing element 252 may provide greater resistance to movement of the yoke in the direction of that biasing element, which can provide a different haptic and tactile experience for the user.

FIG. 6-5 illustrates another embodiment of a post 226-5 with only a single biasing element 252 positioned around a central rod 255. Tilting of the yoke in either rotational direction will apply a compressive force to the biasing element 252. The biasing element 252 can then apply a restorative force to bias the yoke back to a center point about either rotational axis.

Figure 7:
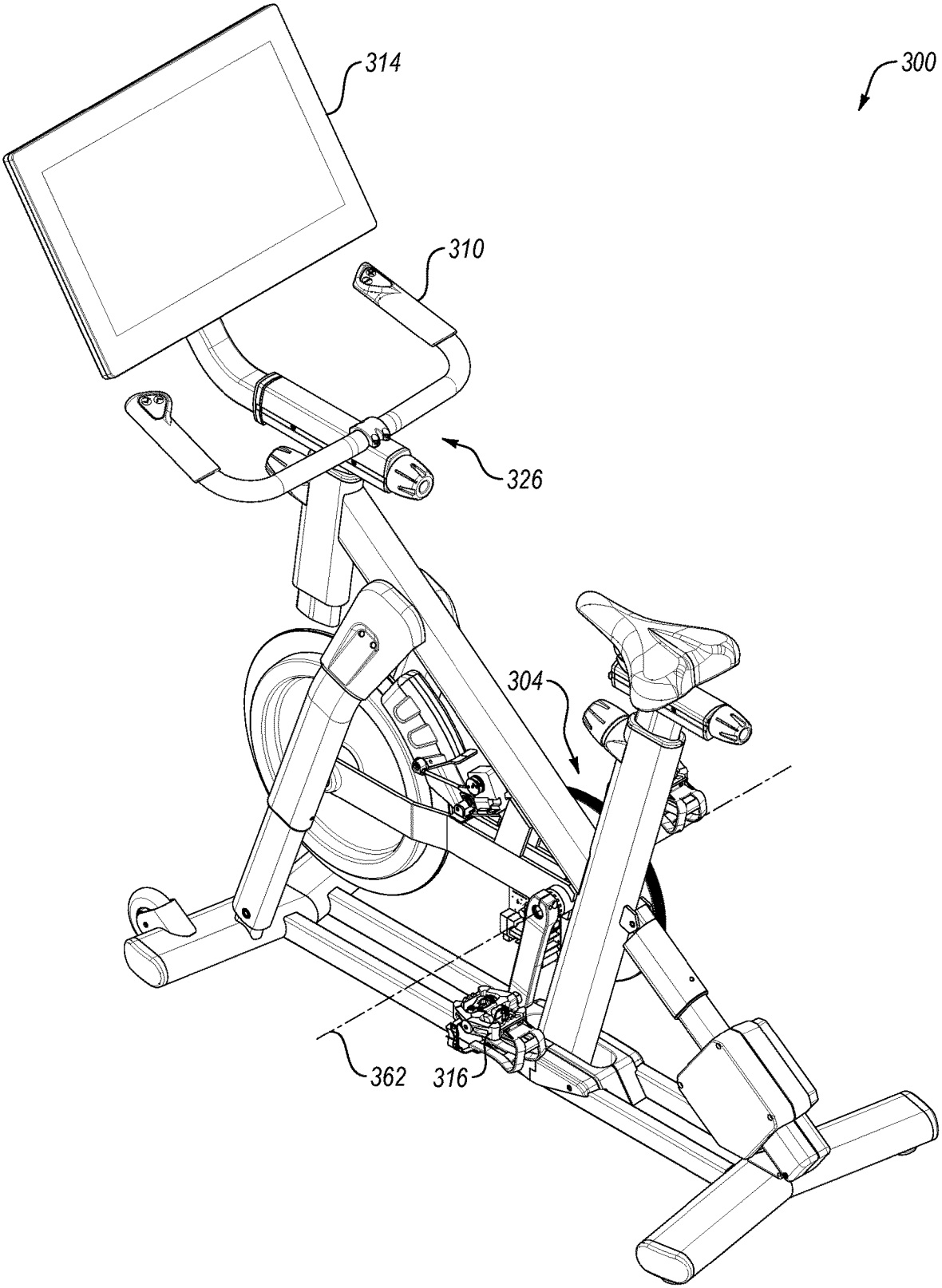
FIG. 7 is a perspective view of another interactive exercise device, according to at least one embodiment of the present disclosure.

In addition to the directional inputs through the handlebars, a user may provide directional and/or movement inputs through the drivetrain of the exercise bicycle. FIG. 7 is a perspective view of another embodiment of an exercise bicycle 300. The drivetrain can include one or more sensors to transmit inputs to the computing device 314. In some embodiments, both the drivetrain 304 and the handlebars 310 provide user inputs to the computing device 314. In other embodiments, only one of the drivetrain 304 and the handlebars 310 provides user inputs to the computing device 314.

As described herein, the handlebars 310 can provide rotational and/or translational directional inputs in one, two, or three axes. The drivetrain 304 can provide input along the rotational axis of the pedals 316. For example, the user may move the pedals 316 in a forward rotational direction or a rearward rotational direction about the pedal axis 362. As pedaling the drivetrain 304 in a forward rotational direction intuitively would move a user forward on a bicycle, pedaling the drivetrain 304 can provide a forward directional input to a computing device 314. In other examples, pedaling the drivetrain 304 in the opposite rearward rotational direction can provide a rearward directional input to the computing device 314, much as backpedaling a fixed gear bicycle would move the user in a rearward direction.

Figures 1, 8:
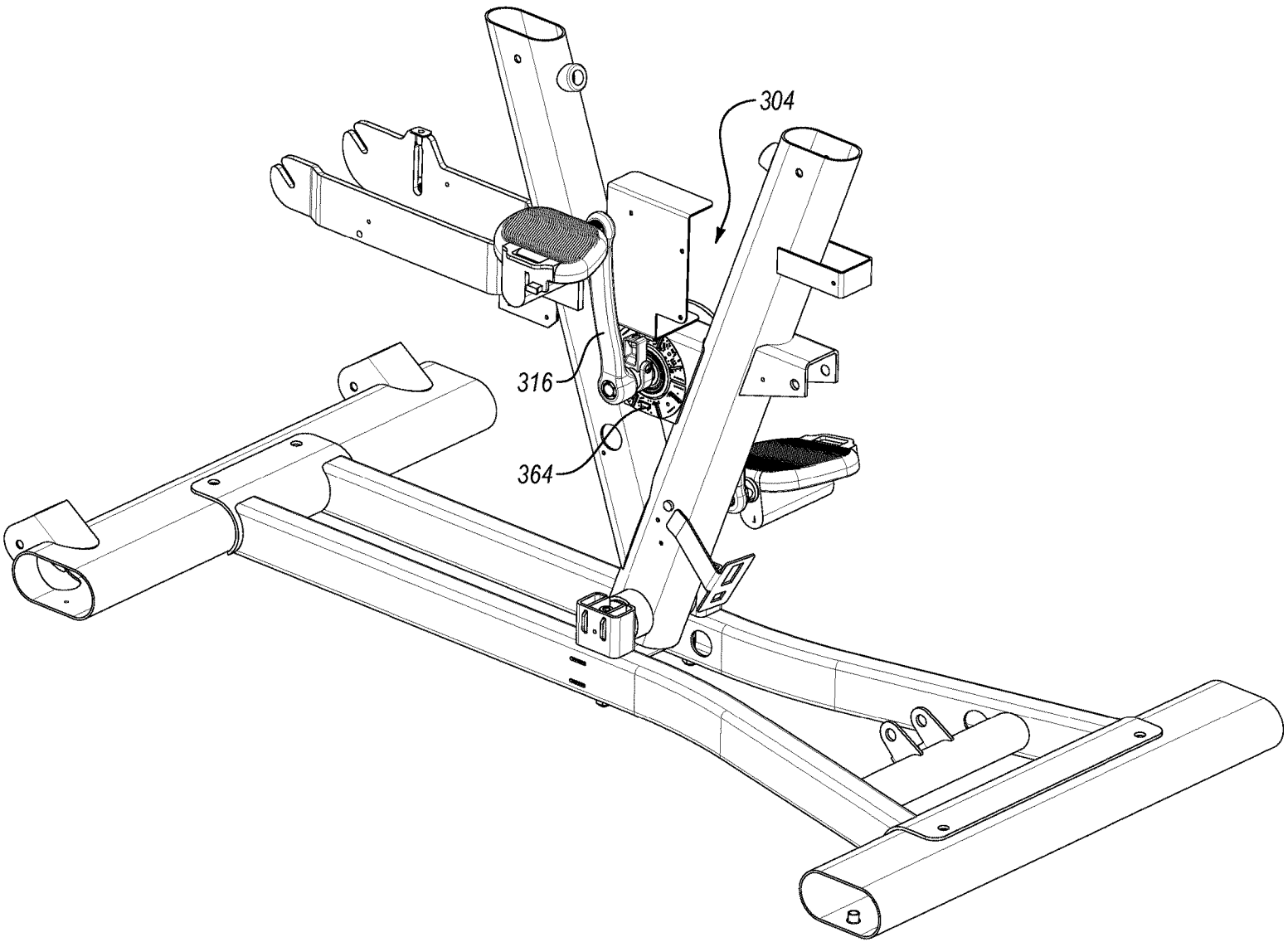
Figures 3, 8:
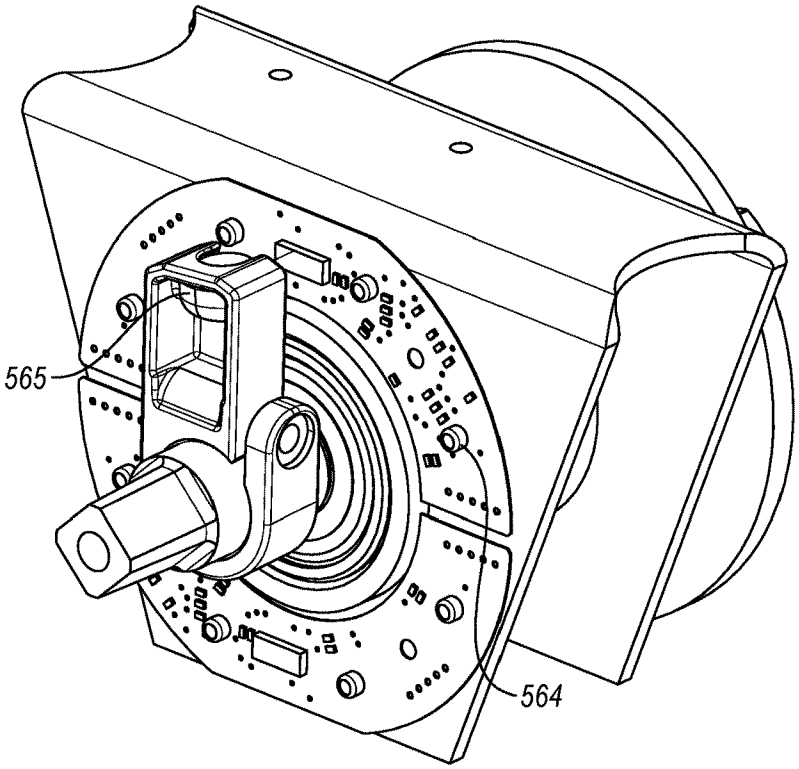
Figures 2, 8:
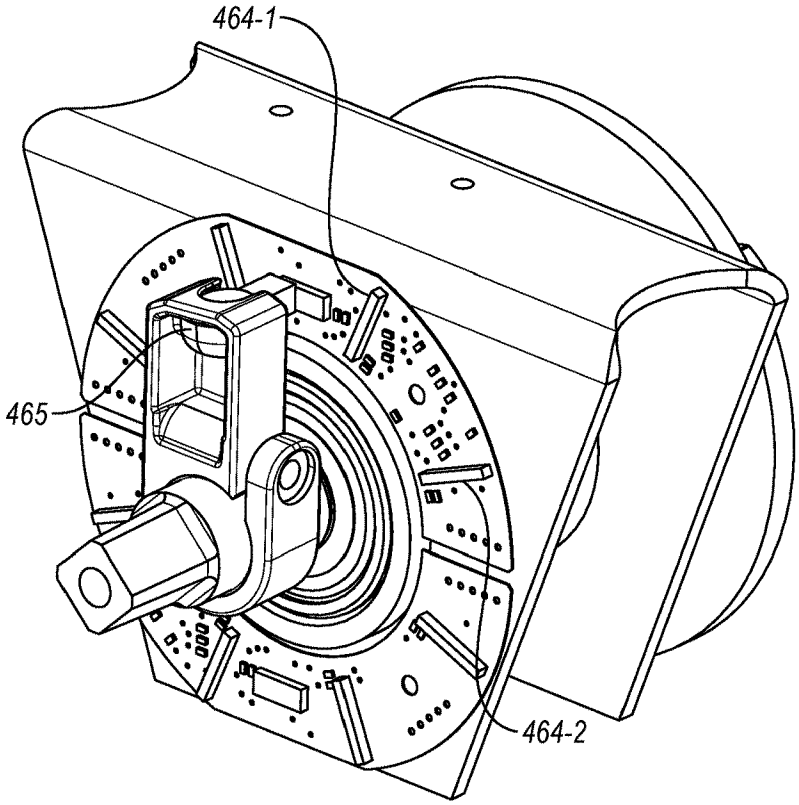

FIG. 8-1 is a detail view of the drivetrain 304 of FIG. 7. FIG. 8-1 illustrates an example of a sensor 364 array positioned in a crank of the pedals 316. The sensor 364 array may be a brush switch array that measures both the movement and position of the pedals 316 through a physical contact that moves relative to the sensors 364 with the pedals 316. In some examples, the sensor 364 or sensor 364 array measures the rate of movement of the pedals 316. In other examples, the sensor 364 or sensor 364 array measures the direction of movement of the pedals 316. In yet other examples, the sensor 364 or sensor 364 array measures the direction of movement and the rate of movement of the pedals 316.

The sensor array 364 on the crank may allow the user to pedal forward or backward, and at different rotational speeds, to provide a directional input to a computing device, such as computing device 314 of FIG. 7. FIG. 8-2 illustrates another embodiment of a magnetic reed switch sensor array with a plurality of sensors 464-1, 464-2. A magnet 465 is configured to rotate relative to the sensor array when the pedals turn. As the magnet 465 passes the first sensor 464-1, the magnet 465 moves the reed switch in the first sensor 464-1, and the sensor array detects the position of the magnet 465 (and hence the pedals) relative to the first sensor 464-1. As the magnet 465 moves past the second sensor 464-2, the magnet 465 moves the reed switch in the second sensor 464-2, and the sensor array detects the position of the magnet 465 relative to the second sensor 464-2. In some embodiments, when the magnet 465 is positioned rotationally between the first sensor 464-1 and the second sensor 464-2, the magnet 465 moves the reed switches in both the first sensor 464-1 and the second sensor 464-2, allowing the sensor array to detect the position of the magnet 465 between the first sensor 464-1 and the second sensor 464-2.

FIG. 8-3 is another example of a sensor array positioned at the crank of a drivetrain. The sensor array includes a plurality of photoreceptor sensors 564. A light source 565 is configured to rotate relative to the sensor array when the pedals turn. As the light source 565 passes a photoreceptor sensor 564, the light source 565 delivers light to the photoreceptor sensor 564, and the sensor array detects the position of the light source 565 (and hence the pedals) relative to the photoreceptor sensor 564.

Figure 9:
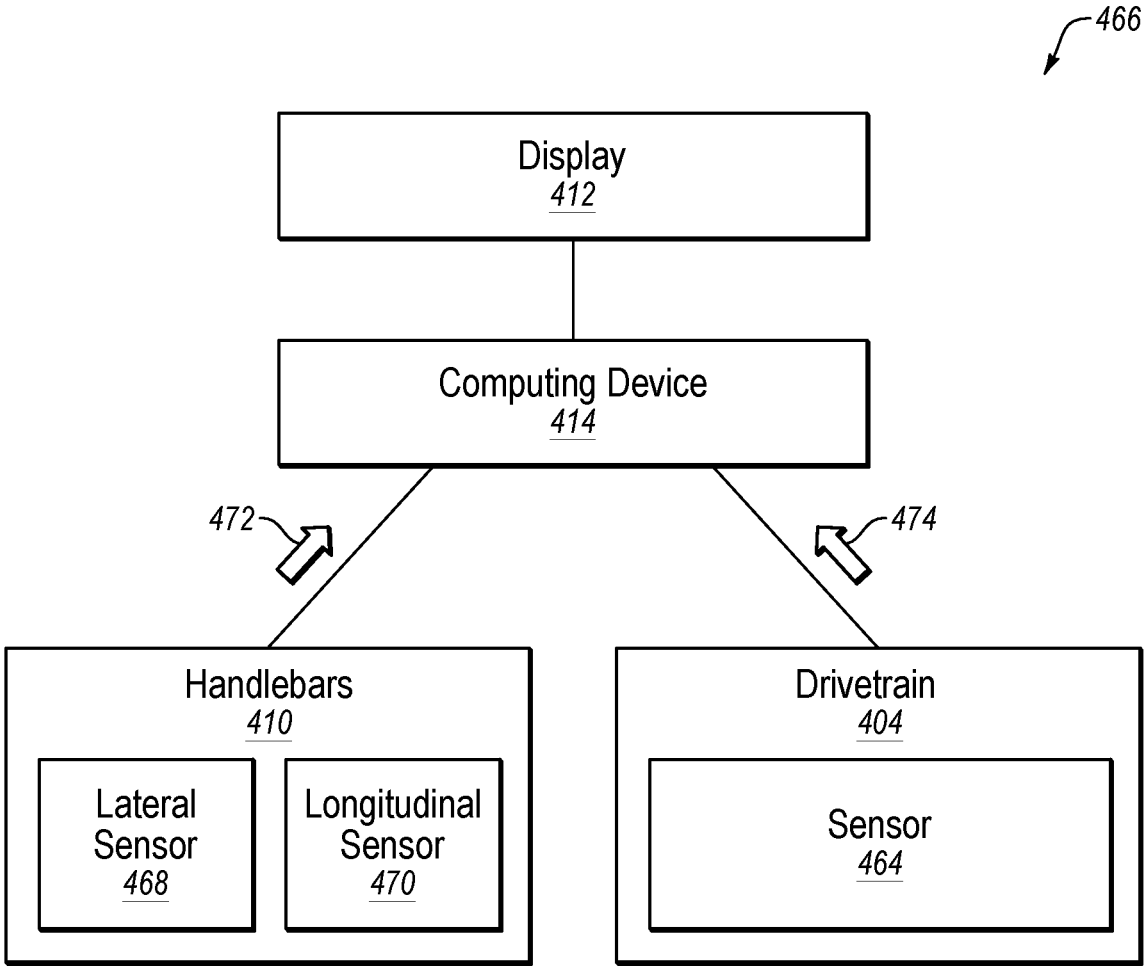
FIG. 9 is a system diagram illustrating an interactive exercise device receiving user inputs, according to at least one embodiment of the present disclosure.

FIG. 9 is a system diagram illustrating an example interactive exercise system 466 utilizing handlebars 410 and/or a drivetrain 404, according to the present disclosure. In other embodiments, an interactive exercise system according to the present disclosure includes handlebars 410 according to the present disclosure, but may lack a sensor 464 on the drivetrain 404. In yet other embodiments, an interactive exercise system according to the present disclosure includes a drivetrain 404 according to the present disclosure, but not movable handlebars 410.

The interactive exercise system 466 has a computing device 414 that is in data communication with a display 412. The display 412 provides visual information to a user that is generated or provided by the computing device 414. The computing device 414 is in data communication with at least one of handlebars 410 and a drivetrain 404. The handlebars 410 may be movable, as described in relation to FIG. 2 through FIG. 6, and include at least one handlebar sensor. For example, the handlebars 410 may include a lateral sensor 468 that measures a lateral input to the handlebars 410 and/or a longitudinal sensor 470 that measure a longitudinal input to the handlebars 410.

In some embodiments, the handlebar sensor(s) (e.g., lateral sensor 468, longitudinal sensor 470) includes a pressure sensor that measures a force applied to the handlebars 410 by a user. In other embodiments, the handlebar sensor(s) includes an accelerometer or gyroscope that measures the position or movement of the handlebars 410. The handlebar sensor(s) provides a handlebar directional input 472 to the computing device 414.

In some examples, the handlebar direction input 472 can include rotational and/or translational information in one, two, or three axes of the handlebars 410. The computing device 414 receives the handlebar directional input 472 and can provide to the user, via the display 412, visual information that is based at least partially upon the handlebar directional information.

The drivetrain 404 includes at least one drivetrain sensor 464 that provides a drivetrain directional input 474 to the computing device 414. The drivetrain sensor 464 may include a pressure sensor that measures a force applied to the pedals by a user. In other embodiments, the drivetrain sensor 464 includes an accelerometer or gyroscope that measures the position or movement of the pedals. In yet other embodiments, the drivetrain sensor 464 includes a switch array that measures the position and movement of the pedals. The drivetrain sensor 464 may measure the speed and direction of pedal movement and provide that information in the drivetrain directional input 474 to the computing device 414.

Figure 10:
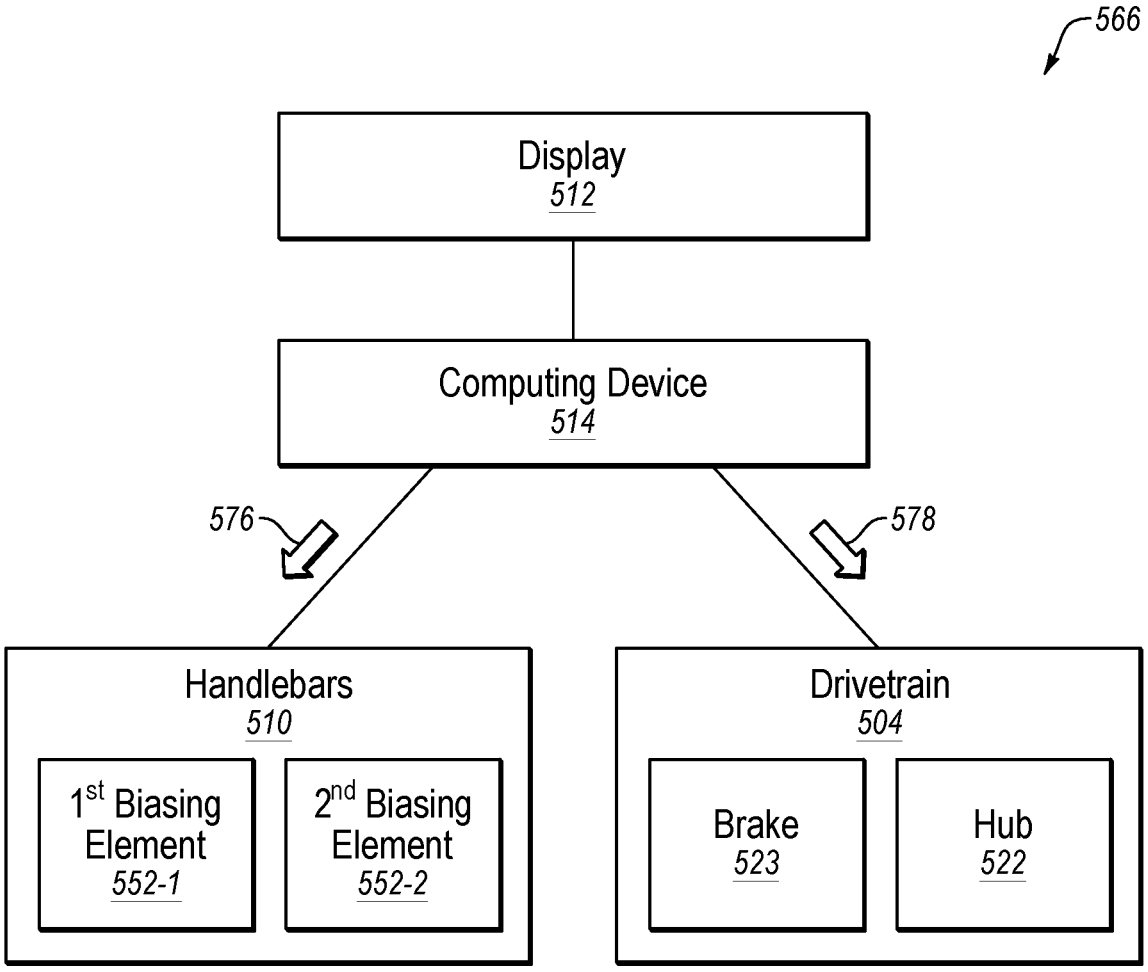
FIG. 10 is a system diagram illustrating an interactive exercise device altering a user experience, according to at least one embodiment of the present disclosure.

In some embodiments, a computing device 514 of an interactive exercise system 566 sends a command to alter the movement, resistance, damping, or other characteristic of the handlebars 510 and/or drivetrain 504 as shown in FIG. 10. For example, the display 512 may display to a user visual information corresponding to a left turn on a road or path. The computing device 514 can send a handlebar command 576 to the handlebars 510. The handlebar command 576 can instruct a first biasing element 552-1 to apply a force and/or alter a damping of the first biasing element 552-1. In the current example, the handlebar command 576 may instruct the first biasing element 552-1 to alter a centerpoint of the handlebar 510 to urge the handlebar 510 to the side and simulate the left turn of the road displayed on the display 512.

In another example, the display 512 may provide visual information to a user corresponding to an upward road or path. The computing device 514 provides a handlebar command 576 to the handlebars 510 to simulate the upward road or path. For example, the handlebar command 576 can instruct a second biasing element 552-2 to apply a force and/or alter a damping of the second biasing element 552-2. In the current example, the handlebar command 576 may instruct the second biasing element 552-2 to alter a centerpoint of the handlebar 510 to rotate the handlebar 510 to the rear and simulate the upward road or path displayed on the display 512.

In yet another example, the display 512 may provide visual information to a user corresponding to an uneven road or path. The computing device 514 provides a handlebar command 576 to the handlebars 510 to simulate the variability of the surface of the road or path. For example, the handlebar command 576 can instruct a first biasing element 552-1 and/or second biasing element 552-2 to apply a force and/or alter a damping of the first biasing element 552-1 and/or second biasing element 552-2. In the current example, the handlebar command 576 may instruct the first biasing element 552-1 and/or second biasing element 552-2 to rapidly alter a centerpoint of the handlebar 510 to simulate the movement of handlebars on a cobblestone, corrugated, or otherwise rough or uneven road or path displayed on the display 512.

Additionally, or alternatively, the computing device 514 can send a drivetrain command 578 to one or more components of the drivetrain 504 to alter the behavior of the drivetrain relative to a road or path displayed to the user on the display 512. The computing device 514 provides a drivetrain command 578 to the drivetrain 504 to simulate the upward road or path. For example, the drivetrain command 578 can instruct a brake 523 and/or hub 522 to apply a torque and/or alter a resistance of the drivetrain 504. In the current example, the drivetrain command 578 may instruct the drivetrain 504 to alter a resistance of the hub 522 to simulate the upward road or path displayed on the display 512.

INDUSTRIAL APPLICABILITY

In general, the present invention relates to providing a directional input mechanism on an exercise bicycle. In some embodiments, the directional input mechanism is handlebars of the exercise bicycle. For example, the handlebars may move relative to a frame of the exercise bicycle, and the amount of movement provides the directional input. In other examples, the handlebars are in communication with a pressure sensor that measures the force applied to the handlebars, and the amount of force provides the directional input. In other embodiments, the directional input mechanism is the drivetrain of the exercise bicycle. For example, the drivetrain includes one or more sensors to measure the movement direction and/or speed of the pedals.

The exercise bicycle includes a frame that supports a drivetrain and at least one wheel. The frame may further support a seat for a user to sit upon, handlebars for a user to grip, one or more displays, or combinations thereof. In some embodiments, the display is supported by the frame. In other embodiments, the display is separate from the frame, such as a wall-mounted display. In yet other embodiments, the display is a head-mounted display (HMD) worn by the user, such as a virtual reality, mixed reality, or augmented reality HMD.

In some embodiments, an exercise bicycle may use one or more displays to display feedback or other data regarding the operation of the exercise bicycle. In some embodiments, the drivetrain and/or handlebars may be in data communication with the display such that the display presents real-time information or feedback collected from one or more sensors on the drivetrain and/or handlebars. For example, the display may present information to the user regarding cadence, wattage, simulated distance, duration, simulated speed, resistance, incline, heart rate, respiratory rate, other measured or calculated data, or combinations thereof. In other examples, the display may present use instructions to a user, such as workout instructions for predetermined workout regimens (stored locally or accessed via a network); live workout regimens, such as live workouts broadcast via a network connection; or simulated bicycle rides, such as replicated stages of real-world bicycle races. In yet other examples, the display may present one or more entertainment options to a user during usage of the exercise bicycle.

The display may display locally stored videos and/or audio, video and/or audio streamed via a network connection, video and/or audio displayed from a connected device (such as a smartphone, laptop, or other computing device connected to the display), dynamically generated images using a connected or integrated device, or other entertainment sources. In other embodiments, an exercise bicycle may lack a display on the exercise bicycle, and the exercise bicycle may provide information to an external or peripheral display or computing device in alternative to or in addition to a display. For example, the exercise bicycle may communicate with a smartphone, wearable device, tablet computer, laptop, or other electronic device to allow a user to log their exercise information.

The exercise bicycle has a computing device in data communication with one or more components of the exercise bicycle. For example, the computing device may allow the exercise bicycle to collect information from the drivetrain and/or handlebars and display such information, or visual information based on the drivetrain information, in real-time. In other examples, the computing device may send a command to activate one or more components of the exercise device to alter the behavior of the exercise device. For example, the frame may move to simulate an incline or decline displayed on the display during a training session by tilting the frame with a tilt motor. Similarly, the drivetrain may change to alter resistance, gear, or other characteristics to simulate different experiences for a user. The drivetrain may increase resistance to simulate climbing a hill, riding through sand or mud, or other experience that requires greater energy input from the user, or the drivetrain may change gear (e.g., physically or "virtually") and the distance calculated by the computing device may reflect the selected gear.

In some embodiments, the handlebars are movable relative to the frame. The user may move the handlebars relative to the frame to provide directional inputs to the computing device. For example, the display may present images to the user of a dynamically-generated virtual or mixed reality environment, such as used in a computer game. The images of the virtual environment may change as the user provides directional inputs via the drivetrain (e.g., by pedaling) and/or the handlebars (e.g., by tilting or moving the handlebars relative to the frame).

In some examples, the handlebars include one or more sensors, such as accelerometers, gyroscopes, pressure sensors, torque sensors, or other sensors, that measure the movement and/or position of the handlebars. In some embodiments, the sensors measure the movement and/or position of the handlebars relative to the frame. In other embodiments, the sensors measure the movement and/or position of the handlebars relative to an initial position in space. In yet other embodiments, the sensors measure the movement and/or position of the handlebars relative to the direction of gravity.

In some embodiments, the sensors measure the movement and/or position of the handlebars and/or drivetrain with a sampling rate in a range having an upper value, a lower value, or upper and lower values including any of 30 Hertz (Hz), 45 Hz, 60 Hz, 75 Hz, 90 Hz, 120 Hz, 150 Hz, 180 Hz, 210 Hz, 240 Hz, or any values therebetween. For example, the sampling rate may be greater than 30 Hz. In other examples, the sampling rate may be less than 240 Hz. In yet other examples, the sampling rate may be between 30 and 240 Hz. In further examples, the sampling rate may be between 60 and 120 Hertz. In at least one example, the sampling rate is about 65 Hz.

In other embodiments, the drivetrain and/or handlebars may be in data communication with the display such that the drivetrain and/or handlebars may change and/or move to simulate one or more portions of an exercise experience. The display may present an incline to a user and the drivetrain may increase in resistance to reflect the simulated incline. In at least one embodiment, the display may present an incline to the user and the frame may incline and the drivetrain may increase resistance simultaneously to create an immersive experience for a user. In other embodiments, the display may display a curve in a road or track, and the handlebars may tilt or move around a rotational axis relative to the frame to simulate leaning or movement of the exercise bicycle.

The computing device may allow tracking of exercise information, logging of exercise information, communication of exercise information to an external electronic device, or combinations thereof with or without a display. For example, the computing device may include a communications device that allows the computing device to communicate data to a third-party storage device (e.g., internet and/or cloud storage) that may be subsequently accessed by a user.

In some embodiments, the drivetrain may include an input component that receives an input force from the user and a drive mechanism that transmits the force through the drivetrain to a hub that moves a wheel. The input component can be a set of pedals that allow the user to apply a force to a belt. The belt may rotate an axle. The rotation of the axle may be transmitted to a wheel by a hub. In some embodiments, the wheel may be a flywheel.

In some embodiments, the computing device receives information from the drivetrain and/or alter the drivetrain as the user "moves" in a virtual or mixed environment. For example, the hub may alter the resistance of the drivetrain in response to user moving in a virtual environment. In a particular example, the user may move the handlebars to provide a directional input upward, and the drivetrain may increase resistance on the pedals to simulate pedaling upward. For safety purposes, a brake may be positioned on or supported by the frame and configured to stop or slow the wheel or other part of the drivetrain.

In some embodiments, the brake may be a friction brake, such as a drag brake, a drum brake, caliper brake, a cantilever brake, or a disc brake, that may be actuated mechanically, hydraulically, pneumatically, electronically, by other means, or combinations thereof. In other embodiments, the brake may be a magnetic brake that slows and/or stops the movement of the wheel and/or drivetrain through the application of magnetic fields. In some examples, the brake may be manually forced in contact with the wheel by a user rotating a knob to move the brake. In other examples, the brake may be a disc brake with a caliper hydraulically actuated with a lever on the handlebars. In yet other examples, the brake may be actuated by the computing device in response to one or more sensors.

Handlebars can include a supporting post that allows movement of the handlebars. The post may be fixed relative to the frame of the exercise bicycle or other exercise device, such that movement of the handlebars relative to the post moves the handlebars relative to the frame. The handlebars include a yoke supported by a stem. The stem is connected to the post by a movable connection.

The post can have a two-axis movable connection. For example, the yoke and stem may move relative to the post around a first axis and a second axis oriented orthogonally to the first axis. The first axis may be a longitudinal axis of the frame and the second axis may be a lateral axis of the frame. In such examples, rotation of the yoke around the first axis tilts the yoke laterally (i.e., left and right) relative to the post and frame while rotation of the yoke around the second axis tilts the yoke longitudinally (i.e., forward and rearward) relative to the post and frame. In other examples, the yoke may rotate about a vertical axis, allowing twisting of the yoke in the direction of the stem and/or post.

In some embodiments, the yoke is a curved yoke. For example, the illustrated embodiment shows a yoke with lower portion near the stem and an upward curved portion that terminates in an upper handle. In another example, a curved yoke may have a downward curving portion, such as drop handlebars common to road bicycles, with a lower handle. In other embodiments, the yoke is a flat yoke common to mountain bicycles. For example, the yoke may be approximately straight from one end to the other or approximately straight between the stem and an end of the yoke. In yet other embodiments, the yoke is a flat yoke with bar end grips. For example, the yoke may be a flat bar with bar end grips that extend upward from the flat bar.

The yoke and stem rotate around the first axis and second axis. In some embodiments, the range of motion around the first axis and the range of motion around the second axis are the same. In other embodiments, the range of motion around the first axis is greater than the range of motion around the second axis. In yet other embodiments, the range of motion around the first axis is less than the range of motion around the second axis.

The range of motion of the yoke relative to the post around either the first axis, the second axis, or the third axis in each direction is in a range having an upper value, a lower value, or upper and lower values including any of 5°, 10°, 20°, 30°, 40°, 50°, 60°, 70°, 80°, 90°, or any values therebetween. For example, the range of motion from a centerpoint around the first axis, the second axis, or the third axis may be greater than 5° in each direction. In other examples, the range of motion around the first axis, the second axis, or the third axis may be less than 90°. In yet other examples, the range of motion around the first axis, the second axis, or the third axis may be between 5° and 90°. In further examples, the range of motion around the first axis, the second axis, or the third axis may be between 20° and 70°. In yet further examples, the range of motion around the first axis, the second axis, or the third axis may be between 30° and 60°. In at least one example, it may be critical that the range of motion around the first axis, the second axis, or the third axis in each direction is at least 45°.

In other embodiments, the yoke may be movable relative to the post in a linear fashion. For example, the yoke may translate in a direction of the first axis, the second axis, the third axis, or any direction therebetween. In a particular example, the stem may telescope in the direction of the third axis, such that the yoke can be pushed or pulled relative to the post. In some embodiments, the translational axis (e.g., the third axis) may tilt with the yoke and stem, allowing the yoke to be pushed or pulled relative to the post while the yoke is rotated relative to the post.

The stem can have a mounting bracket that connects the yoke to the stem. In some embodiments, the mounting bracket fixes the yoke relative to the stem. In other embodiments, the mounting bracket allows movement of the yoke relative to the stem in at least one direction. For example, the mounting bracket may include race bearings to allow rotation of the yoke relative to the stem.

In some embodiments, the post has a housing and a bottom plate. The bottom plate may be fastened or connected to the housing to enclose the post. In other examples, the bottom plate may be a part of a frame or other portion of an exercise device to which the post is connected. The housing and/or bottom plate may allow one or more biasing members to be positioned at least partially inside the post to bias and/or dampen the movement of the stem and/or yoke during usage.

In some embodiments, the yoke may be interchangeable with a selection of yokes to allow customization of the exercise device to a user's preferences or to the different requirements of an exercise or entertainment system. The post may retain all of the functionalities described herein, while the yoke is easily changed between different styles or configurations. For example, the yoke of contains a plurality of buttons or other input controls positioned on the yoke. A connection plate has electrical contacts that allow the buttons of the yoke to communicate with the post. When the yoke is changed to a second yoke with a different configuration, the second yoke may communicate with the post via the electrical contacts, also, simplifying the customization of the handlebars.

The post includes biasing elements that bias the stem toward a centered position relative to the post. In some embodiments, the centered position is coaxial with or in line with the post. In other embodiments, the centered position is oriented at an angle to the post. The centered position is, in either case, a stable position to which the stem and yoke return, relative to the post, when a user removes an applied force or other input from the yoke and stem.

The stem can move from the centered position around the first axis and/or second axis as a user applies a force to the yoke and stem. The biasing elements can resist the rotation of the stem around the first axis and/or second axis and bias the stem back toward the centered position. In some examples, the post has at least one first biasing element that biases the stem in relation to the first axis. In other examples, the post has a plurality of first biasing elements that work in concert to bias the stem toward a centered position around the first axis. The first biasing elements may be positioned on either side of a contact plate at the top of the post opposite one another. In some embodiments, the first biasing element includes a spring. In other embodiments, the first biasing element includes a piston and cylinder. In other embodiments, the first biasing element includes a bushing.

In some examples, the post has at least one second biasing element that biases the stem in relation to the second axis. In other examples, the post has a plurality of second biasing elements that bias the stem in relation to the second axis. The second biasing elements may be positioned on either side of a contact plate at the top of the post opposite one another. In some embodiments, the second biasing elements includes a spring. In other embodiments, the second biasing elements includes a piston and cylinder. In other embodiments, the second biasing elements includes a bushing.

The first biasing elements and second biasing elements apply a force between the contact plate and an opposite base plate. In some embodiments, the base plate may be the same as the bottom plate. In other embodiments, the base plate may be different from the bottom plate. In at least one example, the base plate may be movable relative to the bottom plate to adjust the preload and/or damping of the biasing elements.

In some embodiments, the contact plate contacts an inner ring of the stem and an outer ring of the stem. The inner ring may be rotatable around the first axis and the outer ring may be rotatable around the second axis. The outer ring and inner ring and supported by a first axle and a second axle, respectively. The first axle allows rotation around the first axis and the second axle allows rotation around the second axis.

The post and/or stem contains at least one sensor to measure the movement and/or position of the stem and yoke. In some embodiments, the contact plate and/or the base plate include a pressure sensor that measures changes in the force applied by the first biasing elements and the second biasing elements during movement of the yoke. In other embodiments, the contact plate and/or the base plate include an accelerometer or gyroscope that measures the movement and/or position of the yoke.

In some embodiments, the first biasing elements and/or second biasing elements may have equal spring constants. In other words, the first biasing elements and/or second biasing elements may each produce an equal restorative force in response to compression and/or extension of the first biasing elements and/or second biasing elements. In other embodiments, the biasing elements may have different spring constants to customize the user's experience and/or to allow directional inputs to be entered more easily in certain directions.

For example, first biasing elements and/or second biasing elements can include four biasing elements oriented at four positions relative to a user. For the purposes of description, the four positions may be North and South (second biasing elements opposing one another) and East and West (first biasing elements opposing one another). In some examples, the East and West biasing elements may be equal, providing equal resistance to rotation toward the left and right from a user's perspective. In some examples, the East and West biasing elements may be unequal to compensate for a dominant hand of the user, such as a right-handed user applying greater force on the East biasing element that the West biasing element.

In other examples, the North and South biasing elements may be equal, providing equal resistance to rotation fore and aft from a user's perspective. In some examples, the North and South biasing elements may be unequal to compensate for the unequal leverage that may be applied by a user leaning over the handlebars. In such examples, the South biasing element nearest the user may have a greater spring constant to provide greater resistance, as a user may have greater leverage to push the bottom of the yoke downward. For example, the North and South biasing elements (e.g., the second biasing elements) may have a spring constant ratio between 1:4 (i.e., the South biasing element has a spring constant four times greater than the North biasing element) and 9:10 (the North biasing element has a spring constant that is 90% of the South biasing element). In another example, the spring constant ratio may about 2:3.

In some embodiments, the spring constant of the first biasing elements and/or second biasing elements may be in a range having an upper value a lower value, or upper and lower values including any of 50 pounds per inch (lb/in), 75 lb/in, 100 lb/in, 125 lb/in, 150 lb/in, 175 lb/in, 200 lb/in, or any values therebetween. For example, a spring constant of at least one of the first biasing elements and/or second biasing elements may be greater than 50 lb/in. In other examples, the spring constant of at least one of the first biasing elements and/or second biasing elements may be less than 200 lb/in. In yet other examples, the spring constant of at least one of the first biasing elements and/or second biasing elements may be between 50 lb/in and 200 lb/in. In further examples, the spring constant of at least one of the first biasing elements and/or second biasing elements may be between 75 lb/in and 175 lb/in. In yet further examples, the spring constant of at least one of the first biasing elements and/or second biasing elements may be between 100 lb/in and 150 lb/in. In at least one example, the spring constant the North, East, and West biasing elements may be about 100 lb/in and the South biasing element (nearest the user) may be about 150 lb/in.

The first biasing elements and/or second biasing elements may be in contact with and apply a force to the contact plate. In other examples, an end cap may be positioned on an end of the first biasing elements and/or second biasing elements and between the first biasing elements and/or second biasing elements and the contact plate. The end cap may allow the end of the first biasing elements and/or second biasing elements to slide relative to the contact plate as the contact plate moves with the stem and/or yoke. The end cap may, therefore, reduce wear on the first biasing elements and/or second biasing elements and the contact plate, increasing the operational lifetime of the exercise device.

An embodiment of first biasing elements and/or second biasing elements can include coil springs, but other biasing elements may be used. For example, another embodiment of a post with biasing elements includes a piston and cylinder with a compressible fluid therein. While both coil springs and a piston and cylinder with a compressible fluid can provide a restoring expansive force when compressed, the force curve of the restorative force relative to amount of compression may be different, providing a different haptic and tactile experience for a user.

Yet another embodiment of a post with biasing elements includes elastic tensile bands. The tensile bands provide little to no restorative force in response to compression (due to movement of a stem and/or yoke). However, biasing elements including tensile bands can provide a restorative force in response to extension of the biasing elements, providing another option for a haptic and tactile experience for a user.

Yet other embodiments of a post with biasing elements can include actuatable elements. The biasing elements provide a restorative force as a user moves a yoke of the handlebars, and the actuatable elements may apply a force to move the yoke and/or to preload the biasing elements. For example, the actuatable elements may be motors, solenoids, piston and cylinders or other selectively moveable elements that move in the direction of the biasing elements. The actuatable elements can apply a compressive force to the biasing elements, which may in turn apply a force to move the yoke. In other examples, the actuatable elements can apply a compressive force to the biasing elements to preload the biasing elements. A preloaded biasing element may provide greater resistance to movement of the yoke in the direction of that biasing element, which can provide a different haptic and tactile experience for the user.

Still further embodiments of a post can include only a single biasing element positioned around a central rod. Tilting of the yoke in either rotational direction will apply a compressive force to the biasing element. The biasing element can then apply a restorative force to bias the yoke back to a center point about either rotational axis.

In addition to the directional inputs through the handlebars, a user may provide directional and/or movement inputs through the drivetrain of the exercise bicycle. The drivetrain can include one or more sensors to transmit inputs to the computing device. In some embodiments, both the drivetrain and the handlebars provide user inputs to the computing device. In other embodiments, only one of the drivetrain and the handlebars provides user inputs to the computing device.

The handlebars can provide rotational and/or translational directional inputs in one, two, or three axes. The drivetrain can provide input along the rotational axis of the pedals. For example, the user may move the pedals in a forward rotational direction or a rearward rotational direction about the pedal axis. As pedaling the drivetrain in a forward rotational direction intuitively would move a user forward on a bicycle, pedaling the drivetrain can provide a forward directional input to a computing device. In other examples, pedaling the drivetrain in the opposite rearward rotational direction can provide a rearward directional input to the computing device, much as backpedaling a fixed gear bicycle would move the user in a rearward direction.

A sensor array can be positioned in a crank of the pedals. The sensor array may be a brush switch array that measures both the movement and position of the pedals through a physical contact that moves relative to the sensors with the pedals. In some examples, the sensor or sensor array measures the rate of movement of the pedals. In other examples, the sensor or sensor array measures the direction of movement of the pedals. In yet other examples, the sensor or sensor array measures the direction of movement and the rate of movement of the pedals.

The sensor array on the crank may allow the user to pedal forward or backward, and at different rotational speeds, to provide a directional input to a computing device. In other embodiments, a drivetrain sensor can be a magnetic reed switch sensor array with a plurality of sensors. A magnet is configured to rotate relative to the sensor array when the pedals turn. As the magnet passes the first sensor, the magnet moves the reed switch in the first sensor, and the sensor array detects the position of the magnet (and hence the pedals) relative to the first sensor. As the magnet moves past the second sensor, the magnet moves the reed switch in the second sensor, and the sensor array detects the position of the magnet relative to the second sensor. In some embodiments, when the magnet is positioned rotationally between the first sensor and the second sensor, the magnet moves the reed switches in both the first sensor and the second sensor, allowing the sensor array to detect the position of the magnet between the first sensor and the second sensor.

Another example of drivetrain sensor is a sensor array including a plurality of photoreceptor sensors. A light source is configured to rotate relative to the sensor array when the pedals turn. As the light source passes a photoreceptor sensor, the light source delivers light to the photoreceptor sensor, and the sensor array detects the position of the light source (and hence the pedals) relative to the photoreceptor sensor.

An example interactive exercise system utilizes handlebars and/or a drivetrain. In other embodiments, an interactive exercise system according to the present disclosure includes handlebars according to the present disclosure but may lack a sensor on the drivetrain. In yet other embodiments, an interactive exercise system according to the present disclosure includes a drivetrain according to the present disclosure, but not movable handlebars.

The interactive exercise system has a computing device that is in data communication with a display. The display provides visual information to a user that is generated or provided by the computing device. The computing device is in data communication with at least one of handlebars and a drivetrain. The handlebars may be movable and include at least one handlebar sensor. For example, the handlebars may include a lateral sensor that measure a lateral input to the handlebars and/or a longitudinal sensor that measure a longitudinal input to the handlebars.

In some embodiments, the handlebar sensor(s) includes a pressure sensor that measure a force applied to the handlebars by a user. In other embodiments, the handlebar sensor (s) includes an accelerometer or gyroscope that measures the position or movement of the handlebars. The handlebar sensor(s) provide a handlebar directional input to the computing device.

In some examples, the handlebar direction input can include rotational and/or translational information in one, two, or three axes of the handlebars. The computing device receives the handlebar directional input and can provide to the user, via the display, visual information that is based at least partially upon the handlebar directional information.

The drivetrain includes at least one drivetrain sensor that provides a drivetrain directional input to the computing device. The drivetrain sensor may include a pressure sensor that measure a force applied to the pedals by a user. In other embodiments, the drivetrain sensor includes an accelerometer or gyroscope that measures the position or movement of the pedals. In yet other embodiments, the drivetrain sensor includes a switch array that measures the position and movement of the pedals. The drivetrain sensor may measure the speed and direction of pedal movement and provide that information in the drivetrain directional input to the computing device.

In some embodiments, a computing device of an interactive exercise system sends a command to alter the movement, resistance, damping, or other characteristic of the handlebars and/or drivetrain. For example, the display may display to a user visual information corresponding to left turn on a road or path. The computing device can send a handlebar command to the handlebars. The handlebar command can instruct a first biasing element to apply a force and/or alter a damping of the first biasing element. In the current example, the handlebar command may instruct the first biasing element to alter a centerpoint of the handlebar to urge the handlebar to the side and simulate the left turn of the road displayed on the display.

In another example, the display may provide visual information to a user corresponding to an upward road or path. The computing device provides a handlebar command to the handlebars to simulate the upward road or path. For example, the handlebar command can instruct a second biasing element to apply a force and/or alter a damping of the second biasing element. In the current example, the handlebar command may instruct the second biasing element to alter a centerpoint of the handlebar to rotate the handlebar to the rear and simulate the upward road or path displayed on the display.

In yet another example, the display may provide visual information to a user corresponding to an uneven road or path. The computing device provides a handlebar command to the handlebars to simulate the variability of the surface of the road or path. For example, the handlebar command can instruct a first biasing element and/or second biasing element to apply a force and/or alter a damping of the first biasing element and/or second biasing element. In the current example, the handlebar command may instruct the first biasing element and/or second biasing element to rapidly alter a centerpoint of the handlebar to simulate the movement of handlebars on a cobblestone, corrugated, or otherwise rough or uneven road or path displayed on the display.

Additionally, or alternatively, the computing device can send a drivetrain command to one or more components of the drivetrain to alter the behavior of the drivetrain relative to a road or path displayed to the user on the display. The computing device provides a drivetrain command to the drivetrain to simulate the upward road or path. For example, the drivetrain command can instruct a brake and/or hub to apply a torque and/or alter a resistance of the drivetrain. In the current example, the drivetrain command may instruct the drivetrain to alter a resistance of the hub to simulate the upward road or path displayed on the display.

In at least one embodiment of the present disclosure, an interactive exercise device may include one or more mechanisms to provide directional inputs to a computing device, and the computing device can generate a virtual or mixed reality environment based upon the directional inputs. The directional inputs are received from movable handlebars and/or drivetrain with at least one sensor to measure the position and/or movement of the handlebars and/or drivetrain.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

By way of example, interactive exercise devices according to the present disclosure may be described according to any of the following sections:

1. An exercise device comprising:
   a frame;
   handlebars supported by the frame, the handlebars including:
      a yoke that is movable relative to the frame, a biasing element positioned between the yoke and the frame, and a sensor configured to measure a movement of the yoke; and a computing device in data communication with the sensor.

2. The exercise device of section 1, the biasing element including a spring.

3. The exercise device of section 1, the sensor having a sampling rate between 30 Hz and 240 Hz.

4. The exercise device of section 1, the biasing element including a plurality of biasing elements positioned opposite one another around an axis to bias the yoke toward a centerpoint around the axis.

5. The exercise device of section 1, the biasing element being a first biasing element configured to bias the yoke around a first axis and further comprising a second biasing element configured to bias the yoke around a second axis.

6. The exercise device of section 5, the first biasing element including a plurality of biasing elements positioned opposite one another around the first axis to bias the yoke toward a centerpoint around the first axis, and the second biasing element including a plurality of biasing elements positioned opposite one another around the second axis to bias the yoke toward a centerpoint around the second axis.

7. The exercise device of section 6, the first biasing element including a plurality of biasing elements with a spring constant ratio between 1:4 and 9:10

8. The exercise device of section 1, the sensor being a pressure sensor to measure a force applied to the yoke.

9. The exercise device of section 1, the handlebars having range of motion greater than 5° around at least one axis.

10. An exercise device comprising:

a frame;

handlebars supported by the frame, the handlebars including:

a yoke that is movable relative to the frame, a biasing element positioned between the yoke and the frame, and a handlebar sensor configured to measure a movement of the yoke;

a drivetrain supported by the frame, the drivetrain including:

pedals rotatable around a pedal axis, and a drivetrain sensor positioned in the drivetrain to measure movement of the pedals; and a computing device in data communication with the handlebar sensor and the drivetrain sensor.

11. The exercise device of section 10, further comprising a display in data communication with the computing device.

12. The exercise device of section 11, the display being a head mounted display (HMD).

13. The exercise device of section 10, the drivetrain sensor being positioned in a crank of the pedals, the drivetrain sensor measuring movement and position of the pedals relative to the frame.

14. The exercise device of section 13, the drivetrain sensor being a sensor array.

15. The exercise device of section 10, the handlebars configured to send a handlebar directional input from the handlebar sensor to the computing device.

16. The exercise device of section 10, the drivetrain sensor configured to send a drivetrain directional input to the computing device.

17. The exercise device of section 10, the computing device configured to generate visual information based on a directional input from at least one of the handlebar sensor and the drivetrain sensor.

18. The exercise device of section 10, the computing device configured to send a handlebar command to the biasing element of the handlebars, the handlebar command instructing the biasing element to apply a force or resistance to the yoke.

19. The exercise device of section 10, the computing device configured to send a drivetrain command to the drivetrain, the drivetrain command altering a resistance of the drivetrain.

20. An interactive exercise system comprising:

a frame;

handlebars supported by the frame, the handlebars including:

a yoke that is movable relative to the frame, a biasing element positioned between the yoke and the frame, and a handlebar sensor configured to measure a movement of the yoke;

a drivetrain supported by the frame, the drivetrain including:

pedals rotatable around a pedal axis, and a drivetrain sensor positioned in the drivetrain to measure movement of the pedals;

a display; and a computing device in data communication with the handlebar sensor, the drivetrain sensor, and the display, the computing device configured to receive directional inputs from the drivetrain sensor and handlebar sensor and to generate visual information based partially upon the directional inputs, the visual information being displayed on the display.

What is claimed is:

1. An exercise device comprising:

a frame;

handlebars supported by the frame, the handlebars including:

a yoke that is movable relative to the frame about a first axis, a second axis, and a third axis;

a post connecting the yoke to the frame, the first axis, the second axis, and the third axis being orthogonal at the post, wherein the first axis, the second axis, and the third axis intersect;

a biasing element positioned between the yoke and the frame; and a sensor configured to measure a movement of the yoke; and a computing device in data communication with the sensor.

2. The exercise device of claim 1, the biasing element including a spring.

3. The exercise device of claim 1, the sensor having a sampling rate between 30 Hertz (Hz) and 240 Hz.

4. The exercise device of claim 1, the biasing element including a plurality of biasing elements positioned opposite one another around the first axis to bias the yoke toward a centerpoint around the first axis.

5. The exercise device of claim 1, the biasing element being a first biasing element configured to bias the yoke around the first axis and further comprising a second biasing element configured to bias the yoke around the second axis.

6. The exercise device of claim 5, the first biasing element including a plurality of biasing elements positioned opposite one another around the first axis to bias the yoke toward a centerpoint around the first axis, and the second biasing element including a plurality of biasing elements positioned opposite one another around the second axis to bias the yoke toward a centerpoint around the second axis.

7. The exercise device of claim 6, the plurality of biasing elements having a spring constant ratio between 1:4 and 9:10.

8. The exercise device of claim 1, the sensor being a pressure sensor to measure a force applied to the yoke.

9. The exercise device of claim 1, the handlebars having a range of motion greater than 5° around at least one axis.

10. The exercise device of claim 1, wherein the biasing element is a first biasing element, and wherein the handlebars further include:

a second biasing element opposing the first biasing element;

a third biasing element between the first biasing element and the second biasing element; and a fourth biasing element opposing the third biasing element.

11. An exercise device comprising:

a frame;

handlebars supported by the frame, the handlebars including:

a yoke that is movable relative to the frame about a first axis, a second axis, and a third axis;

a post connecting the yoke to the frame, the first axis, the second axis, and the third axis being orthogonal at the post, wherein the first axis, the second axis, and the third axis intersect;

a biasing element positioned between the yoke and the frame; and a handlebar sensor configured to measure a movement of the yoke;

a drivetrain supported by the frame, the drivetrain including:

pedals rotatable around a pedal axis, and a drivetrain sensor positioned in the drivetrain to measure movement of the pedals; and a computing device in data communication with the handlebar sensor and the drivetrain sensor.

12. The exercise device of claim 11, further comprising a display in data communication with the computing device.

13. The exercise device of claim 12, the display being a head mounted display (HMD).

14. The exercise device of claim 11, the drivetrain sensor being positioned in a crank of the pedals, the drivetrain sensor measuring movement and position of the pedals relative to the frame.

15. The exercise device of claim 14, the drivetrain sensor being a sensor array.

16. The exercise device of claim 11, the handlebars configured to send a handlebar directional input from the handlebar sensor to the computing device.

17. The exercise device of claim 11, the drivetrain sensor configured to send a drivetrain directional input to the computing device.

18. The exercise device of claim 11, the computing device configured to generate visual information based on a directional input from at least one of the handlebar sensor and the drivetrain sensor.

19. The exercise device of claim 11, the computing device configured to send a handlebar command to the biasing element of the handlebars, the handlebar command instructing the biasing element to apply a force or resistance to the yoke.

20. The exercise device of claim 11, the computing device configured to send a drivetrain command to the drivetrain, the drivetrain command altering a resistance of the drivetrain.

21. An interactive exercise system comprising:

a frame;

handlebars supported by the frame, the handlebars including:

a yoke that is movable relative to the frame about a first axis, a second axis, and a third axis;

a post connecting the yoke to the frame;

a plurality of biasing elements positioned between the yoke and the frame, the plurality of biasing elements being parallel to the post; and a handlebar sensor configured to measure a movement of the yoke;

a drivetrain supported by the frame, the drivetrain including:

pedals rotatable around a pedal axis, and a drivetrain sensor positioned in the drivetrain to measure movement of the pedals;

a display; and a computing device in data communication with the handlebar sensor, the drivetrain sensor, and the display, the computing device configured to receive directional inputs from the drivetrain sensor and the handlebar sensor and to generate visual information based partially upon the directional inputs, the visual information being displayed on the display.

* * * * *